US008262182B2

(12) United States Patent
Matsushita

(10) Patent No.: US 8,262,182 B2
(45) Date of Patent: Sep. 11, 2012

(54) FLUID EJECTING APPARATUS AND FLUID EJECTING METHOD

(75) Inventor: Junichiro Matsushita, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 274 days.

(21) Appl. No.: 12/714,623

(22) Filed: Mar. 1, 2010

(65) Prior Publication Data

US 2010/0220134 A1 Sep. 2, 2010

(30) Foreign Application Priority Data

Mar. 2, 2009 (JP) ..... 2009-048390

(51) Int. Cl.
*B41J 29/38* (2006.01)
*B41J 29/393* (2006.01)

(52) U.S. Cl. ..... 347/10; 347/19

(58) Field of Classification Search ..... None
See application file for complete search history.

(56) References Cited

U.S. PATENT DOCUMENTS 6,183,076 B1 * 2/2001 Childers et al. ..... 347/86
6,609,777 B2 * 8/2003 Endo ..... 347/19
7,284,810 B2 10/2007 Igarashi

FOREIGN PATENT DOCUMENTS

JP 2003-266652 9/2003

* cited by examiner

*Primary Examiner* — Stephen Meier
*Assistant Examiner* — Alexander C Witkowski
(74) *Attorney, Agent, or Firm* — Workman Nydegger

(57) ABSTRACT

A fluid ejecting apparatus includes a head that performs a fluid ejecting method by ejecting a fluid on a medium in response to a driving signal. A moving mechanism relatively moves the head and the medium in a predetermined direction. A driving signal generating unit generates the driving signal, which produces a plurality of driving waveforms during a cycle in accordance with a relative moving velocity of the head and the medium in a predetermined direction. The plurality of driving waveforms are repeatedly produced every cycle. A control unit ejects the fluid from the head while the head and the medium are relatively moved in the predetermined direction. The fluid ejecting apparatus causes the driving signal, of which a final driving waveform among the plurality of driving waveforms produced during the cycle is corrected based on the relative moving velocity, to be generated from the driving signal generating unit.

7 Claims, 11 Drawing Sheets

FIG. 11
| MOVING VELOCITY OF HEAD Vc | CORRECTION VALUE OF FINAL DRIVING WAVEFORM Pwh2 |
|---|---|
| MORE THAN 0 LESS THAN Vc(1) | ΔX(1) |
| MORE THAN Vc(1) LESS THAN Vc(2) | ΔX(2) |
| ⋮ | ⋮ |
| MORE THAN Vc(n) LESS THAN Vcs | ΔX(n) |
FIG. 12A
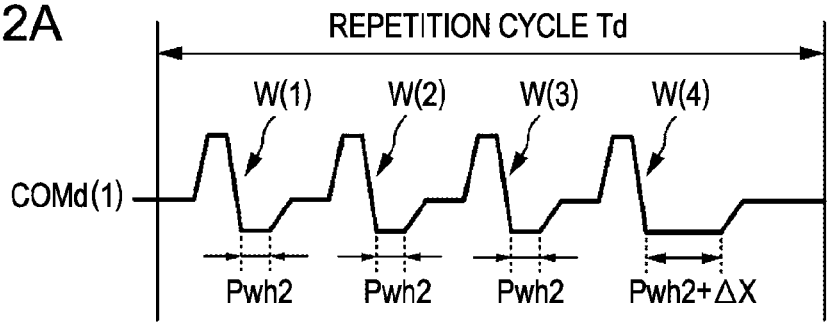
FIG. 12B
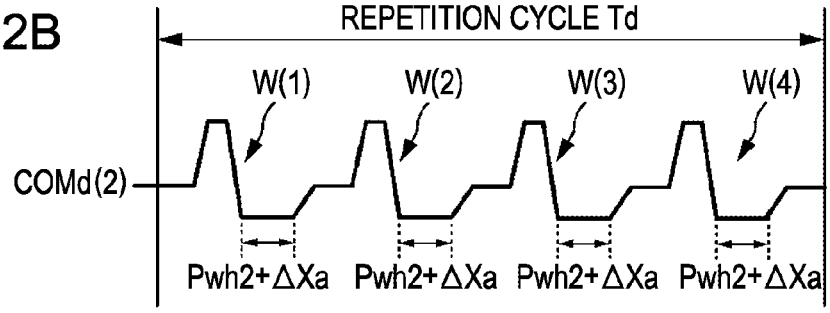

FIG. 13A
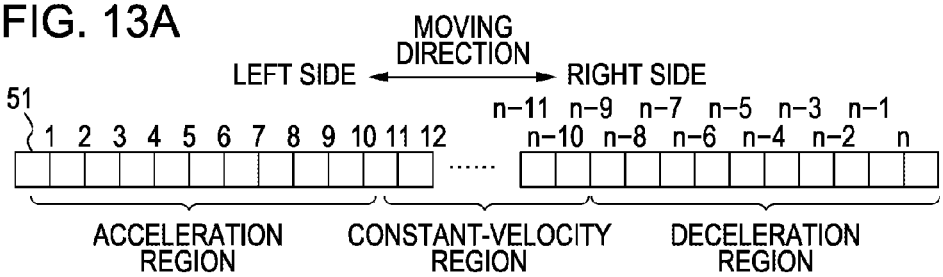
FIG. 13B
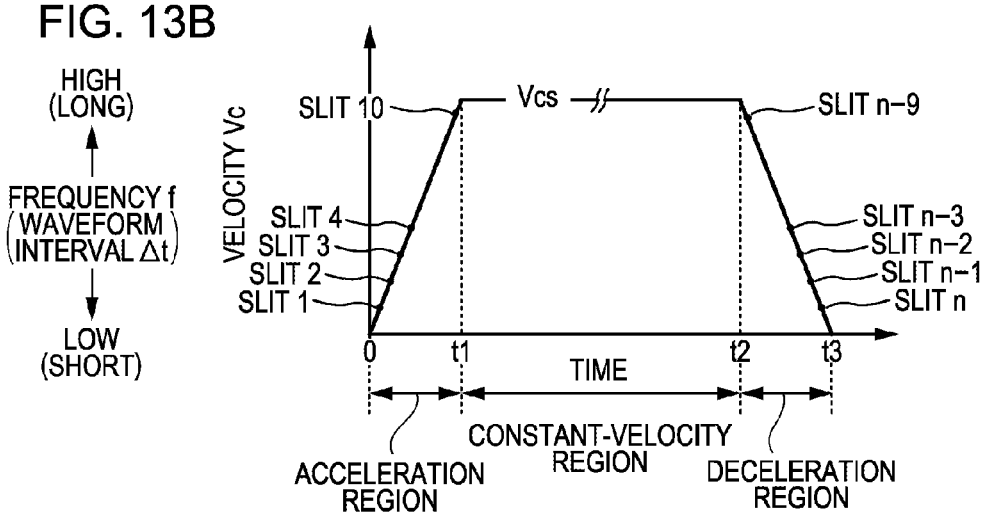
FIG. 13C
| SLIT NUMBER | | CORRECTION VALUE OF FINAL DRIVING WAVEFORM Pwh2 |
|---|---|---|
| ACCELERATION | DECELERATION | |
| 1 | n | ΔX(1) |
| 2 | n−1 | ΔX(2) |
| 3 | n−2 | ΔX(3) |
| ⋮ | ⋮ | ⋮ |
| 10 | n−9 | ΔX(10) |

FIG. 14

| SLIT NUMBER | | CORRECTION VALUE OF FINAL DRIVING WAVEFORM Pwh2 |
|---|---|---|
| ACCELERATION | DECELERATION | |
| 1 TO 3 | n TO n−2 | ΔX(1) |
| 4 TO 5 | n−3 TO n−4 | ΔX(2) |
| 6 TO 7 | n−5 TO n−6 | ΔX(3) |
| ⋮ | ⋮ | ⋮ |
| 9 | n−8 | ΔX(5) |
| 10 | n−9 | ΔX(6) |

FLUID EJECTING APPARATUS AND FLUID EJECTING METHOD

BACKGROUND

1. Technical Field

The present invention relates to a fluid ejecting apparatus and a fluid ejecting method.

2. Related Art

There is known a printer which is capable of ejecting ink droplets (fluid) from a head which moves in a predetermined direction by applying driving waveforms to the head. In such a printer, the ink droplets ejected from the head land on the paper at positions that are shifted in the direction in which the head is moving from ejection positions of the ink droplets. For this reason, it is necessary to eject the ink droplets from the head at a timing earlier than the time at which the head arrives at a target landing position on the paper.

If a moving velocity of the head is a predetermined velocity, it is possible to make the ejection timing of the ink droplets on the paper at the target landing positions uniform. However, the moving velocity of the head is slower than the predetermined velocity during a period in which the velocity gradually accelerates to a predetermined velocity after the head starts to move and during a period in which the velocity gradually decelerates from the predetermined velocity to the time that the head stops. Therefore, if the ejection timing of the ink droplets is uniform, the landing positions of the ink droplets are deviated from the target landing positions.

At the time of acceleration and deceleration of the head (hereinafter, referred to as acceleration and deceleration), a method of delaying the ejection timing of the ink droplets has been proposed (see JP-A-2003-266652). To this end, the generation timing of the driving waveforms is adjusted in accordance to the moving velocity of the head.

As described above, frequencies of the driving waveforms are made different by adjusting the generation timing of the driving waveforms in accordance to the moving velocity of the head. If the frequencies of the driving waveforms are different, the ejection characteristics of the ink droplets, for example, the ejection amount of the ink and the like, are varied. For this reason, only by only adjusting the ejection timing of the ink droplets in accordance with the moving velocity of the head, for example, dots of different sizes are formed, and thus image quality is deteriorated.

SUMMARY

An advantage of some aspects of the invention is that it can stabilize ejection characteristics of a fluid.

According to an embodiment of the invention, there is provided a fluid ejecting apparatus including (A) a head that ejects a fluid on a medium in response to a driving signal, (B) a moving mechanism that relatively moves the head and the medium in a predetermined direction, (C) a driving signal generating unit that generates the driving signal which produces a plurality of driving waveforms during a cycle in accordance with a relative moving velocity of the head and the medium in a predetermined direction, the plurality of driving waveforms being repeatedly produced every cycle, and (D) a control unit that ejects the fluid from the head while the head and the medium are relatively moved in the predetermined direction, and causes the driving signal, of which a final driving waveform among the plurality of driving waveforms produced during the cycle is corrected based on the relative moving velocity, to be generated from the driving signal generating unit.

Other characteristics of the invention will be apparent from the description of the specification and the accompanying drawings.

BRIEF DESCRIPTION OF THE DRAWINGS

The invention will be described with reference to the accompanying drawings, wherein like numbers reference like elements.

FIG. 11 is a table showing a correction value of a second hold time with respect to a head velocity.

FIG. 12A is a view showing a driving signal of which only the final driving waveform is corrected, and FIG. 12B is a view showing a driving signal of which all driving waveforms are corrected.

FIG. 13A is a view showing a relationship between slit numbers and an acceleration and deceleration region, FIG. 13B is a view showing a relationship between the moving velocity and the slit numbers, and FIG. 13C is a view showing a correction value table in which correction values are set to the slit numbers.

FIG. 14 is a view showing a correction value table in which correction values are set to the slit numbers.

DESCRIPTION OF EXEMPLARY EMBODIMENTS

Summary of Disclosure

Figure 1A:
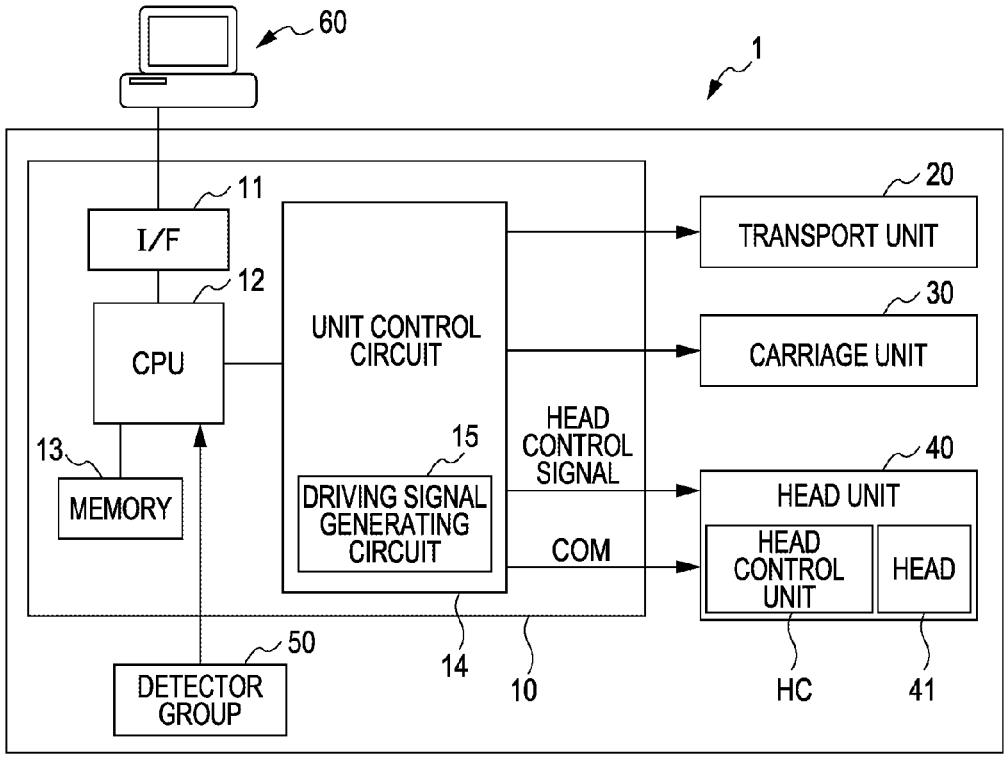
FIG. 1A is a block diagram showing the overall configuration of a printer.

The following points will be apparent from at least the specification and the accompanying drawings.

That is, there is provided a fluid ejecting apparatus including (A) a head that ejects a fluid on a medium in response to a driving signal, (B) a moving mechanism that relatively moves the head and the medium in a predetermined direction, (C) a driving signal generating unit that generates the driving signal which produces a plurality of driving waveforms during a cycle in accordance with a relative moving velocity of the head and the medium in a predetermined direction, the plurality of driving waveforms being repeatedly produced every cycle, and (D) a control unit that ejects the fluid from the head while the head and the medium are relatively moved in the predetermined direction, and causes the driving signal, of which a final driving waveform among the plurality of driving waveforms produced during the cycle is corrected based on the relative moving velocity, to be generated from the driving signal generating unit.

With the above fluid ejecting apparatus, even though a frequency of the driving waveform is varied according to the changed relative moving velocity, it is possible to stabilize a fluid ejection characteristic. Further, the correction processing is easily performed by correcting the final driving waveform during the cycle.

In the fluid ejecting apparatus, the driving waveform is applied to a driving element corresponding to the nozzle provided in the head, so that the driving element is driven. The driving of the driving element causes a pressure chamber communicating with the nozzle corresponding to the driving element to expand or contract, thereby ejecting the fluid from the nozzle. The driving waveform includes an expansion element that expands the pressure chamber, a contraction element that contracts the expanded pressure chamber, and a damping element that suppresses residual vibration generated in the pressure chamber. The control unit causes the driving signal generating unit to generate the driving signal, of which the damping element of the final driving waveform is corrected based on the relative moving velocity.

With the fluid ejecting apparatus, since it does not exert influence on the fluid ejection characteristic due to the final driving waveform of the cycle, it is possible to stabilize the fluid ejection characteristic of the next cycle.

The fluid ejecting apparatus further includes a memory that stores a correction value for correcting the final driving waveform based on the relative moving velocity. The number of the correction values set with respect to the relative moving velocity from a first relative moving velocity to the relative moving velocity which is produced by adding a predetermined velocity to the first relative moving velocity is more than the number of the correction values set with respect to the relative moving velocity from a second relative moving velocity which is slower than the first relative moving velocity to the relative moving velocity which is produced by adding the predetermined velocity to the second relative moving velocity.

With the fluid ejecting apparatus, when the frequency of the driving waveform is low due to a slow relative moving velocity, since fluctuation of the fluid ejection characteristic with respect to variation of the relative moving velocity is small, the number of the correction values is decreased, thereby reducing the necessary memory capacity and thus simplifying the processing of the control unit. Meanwhile, when the frequency of the driving waveform is high due to a fast relative moving velocity, since the fluctuation of the fluid ejection characteristic with respect to the variation of the relative moving velocity is large, the number of the correction values is increased, thereby further stabilizing the fluid ejection characteristic.

In the fluid ejecting apparatus, the driving waveform is applied to the driving element corresponding to the nozzle provided in the head, so that the driving element is driven. The driving of the driving element causes the pressure chamber communicating with the nozzle corresponding to the driving element to expand or contract, thereby ejecting the fluid from the nozzle. The driving waveform includes an expansion element that expands the pressure chamber, a hold element that maintains an expansion state of the pressure chamber, and a contraction element that contracts the expanded pressure chamber. The control unit causes the driving signal generating unit to generate the driving signal, of which the hold element of the final driving waveform is corrected based on the relative moving velocity.

With the fluid ejecting apparatus, it is possible to stabilize the fluid ejection characteristic of the next cycle.

In the fluid ejecting apparatus, the driving waveform is applied to a driving element corresponding to the nozzle provided in the head, so that the driving element is driven. The driving of the driving element causes the pressure chamber communicating with the nozzle corresponding to the driving element to expand or contract, thereby ejecting the fluid from the nozzle. The driving waveform includes an expansion element that expands the pressure chamber, and a contraction element that contracts the expanded pressure chamber. The control unit causes the driving signal generating unit to generate the driving signal, of which the expansion element of the final driving waveform is corrected based on the relative moving velocity.

With the fluid ejecting apparatus, it is possible to stabilize the fluid ejection characteristic of the next cycle.

In the fluid ejecting apparatus, the control unit determines whether or not the fluid is ejected from the head in the next cycle of a certain cycle based on the image data. In the case in which the fluid is ejected from the head in the next cycle, the driving signal generating unit generates the driving signal of which the final driving waveform of the certain cycle is corrected based on the relative moving velocity. In the case in which the fluid is not ejected from the head in the next cycle, the driving signal generating unit generates the driving signal of which the final driving waveform of a certain cycle is not corrected based on the relative moving velocity.

With the fluid ejecting apparatus, it is possible to easily perform the correction processing of the control unit.

Further, a fluid ejecting method for ejecting the fluid from the head in response to the driving signal while the head and the medium are relatively moved in the predetermined direction, the method including: producing the plurality of driving waveforms during a cycle in accordance with the relative moving velocity of the head and the medium in the predetermined direction, to correct a final driving waveform among the plurality of driving waveforms produced during the cycle in the plurality of driving waveforms which are repeatedly produced for every cycle based on the relative moving velocity; and ejecting the fluid from the head in response to the driving signal.

With the fluid ejecting method, even though the frequency of the driving waveform is varied according to changed relative moving velocity, it is possible to stabilize the fluid ejection characteristic. Further, the correction processing is easily performed by correcting the final driving waveform during the cycle.

Configuration of an Ink Jet Printer

An ink jet printer serving as an example of a fluid ejecting apparatus will be described, in which a serial type printer (a printer 1) serves as an example of the ink jet printer herein.

Figure 1B:
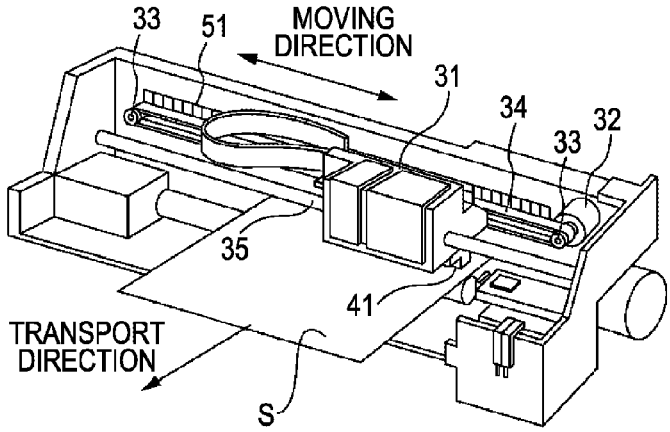
FIG. 1B is a perspective view of the printer.

FIG. 1A is a block diagram showing the overall configuration of the printer 1, and FIG. 1B is a perspective view of the printer 1. The printer 1 receiving print data from a computer 60 which is a peripheral device controls each unit (a transport unit 20, a carriage unit 30, and a head unit 40) by a controller 10 to form an image on paper S (a medium). Further, a detector group 50 detects an internal status of the printer 1, and the controller 10 controls each unit based on the detected results.

The controller 10 (corresponding to a controller unit) is a control unit for controlling the printer 1. The interface portion 11 is adapted to transmit and receive the data between the printer 1 and the computer 60 which is a peripheral device. A CPU 12 is an operation processing device for controlling the overall printer 1. A memory 13 is adapted to secure a working region and a region for storing programs of the CPU 12. The CPU 12 controls each unit by using a unit control circuit 14. The transport unit 20 feeds the paper S to a printable position, and transports the paper S in a transport direction at a predetermined transport amount at the time of printing.

A carriage unit 30 (a moving mechanism) is adapted to move a head 41 in a direction (hereinafter, referred to as a moving direction) intersecting with the transport direction. The timing belt 34 is hung on a pair of pulleys 33, and a portion of the timing belt 34 is connected to a carriage 31. The timing belt 34 is moved by rotation of the pulley 33 which is connected to a rotation shaft of a carriage motor 32, and thus the carriage 31 and the head 41 are moved along a guide shaft 35 in the moving direction. A linear encoder attached to a rear side of the carriage 31 reads a linear scale 51 to control the position of the carriage 31 (the head 41) in the moving direction.

The head unit 40 is adapted to eject the ink on the paper S, and has the head 41 and a head control unit HC. The head 41 is provided at a bottom surface thereof with a plurality of nozzles which serve as an ink ejecting portion. The ink droplets are ejected from the corresponding nozzles by deforming a piezoelectric element (corresponding to a driving element) in response to a driving signal COM which is generated from a driving signal generating circuit 15 (corresponding to a driving signal generating unit) or a head control signal output from the controller 10.

In the serial type printer 1 configured as described above, a dot formation processing which forms the dots on the paper S by intermittently ejecting the ink from the head 41 moving in the moving direction and a transport processing which transports the paper S in the transport direction are alternatively repeated. As a result, the dots can be formed at positions different from the positions of the dots formed by the previous dot formation processing, thereby forming a 2-D image on the paper.

Regarding the Drive of the Head 41

Regarding the Configuration of the Head 41

Figure 2:
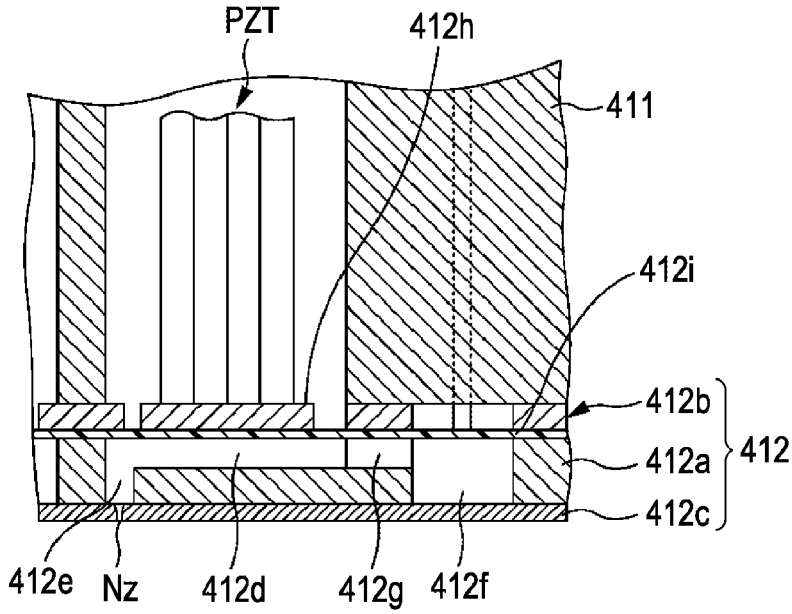
FIG. 2 is a cross-sectional view of a head.

FIG. 2 is a cross-sectional view of the head 41. The head 41 has a body constituted by a case 411, a channel unit 412, and a piezoelectric element group PZT. The case 411 receives the piezoelectric element group PZT therein, and the channel unit 412 is connected to a bottom surface of the case 411.

The channel unit 412 has a channel forming plate 412*a*, a resilient plate 412*b* and a nozzle plate 412*c*. The channel forming plate 412*a* is provided with a groove portion which serves as a pressure chamber 412*d*, a through-hole which serves as a nozzle communicating hole 412*e*, a through-hole which serves a common ink chamber 412*f*, and a groove portion which serves as an ink supply channel 412*g*. The resilient plate 412*b* has an island portion 412*h* to which a leading end of the piezoelectric element group PZT is connected. A resilient region is formed around the island portion 412*h* by a resilient diaphragm 412*i*. The ink stored in an ink cartridge is supplied to the pressure chamber 412*d* corresponding to each nozzle Nz via the common ink chamber 412*f*.

The nozzle plate 412*c* is a plate provided with the nozzles Nz. A nozzle surface (not shown) is provided with a plurality of nozzle arrays each having 180 nozzles Nz which are arranged in parallel in the transport direction at a predetermined interval (e.g., 180 dpi). The color printing can be performed by ejecting ink of different colors from each of the nozzle arrays.

The piezoelectric element group PZT has a plurality of pectinate piezoelectric elements, and the number installed is equal to the number of the nozzles Nz. The piezoelectric elements are applied by the driving signal COM by a wiring substrate (not shown) mounted with a head control unit HC or the like, and the piezoelectric element group PZT is expanded and contracted in upward and downward directions in response to electric potential of the driving signal COM. If the piezoelectric element group PZT (hereinafter, referred to as a piezoelectric element) is expanded and contracted, the island portion 412*h* is pushed toward the pressure chamber 412*d* side, or is pulled in an opposition direction. In this instance, the resilient diaphragm 412*i* around the island portion 412*h* is deformed, and the pressure in the pressure chamber 412*d* is increased or lowered, so that the ink droplets are ejected from the nozzles.

Regarding the Driving Signal Generating Circuit 15

Figure 3:
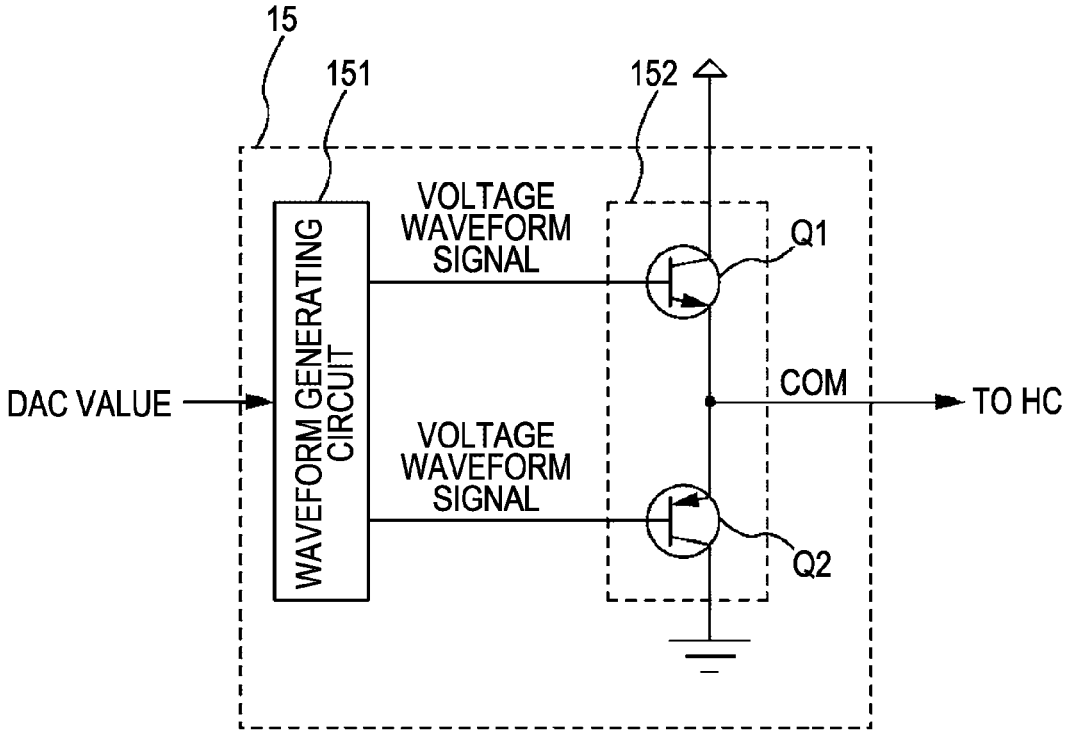
FIG. 3 is a view showing a driving signal generating circuit.
Figure 4:
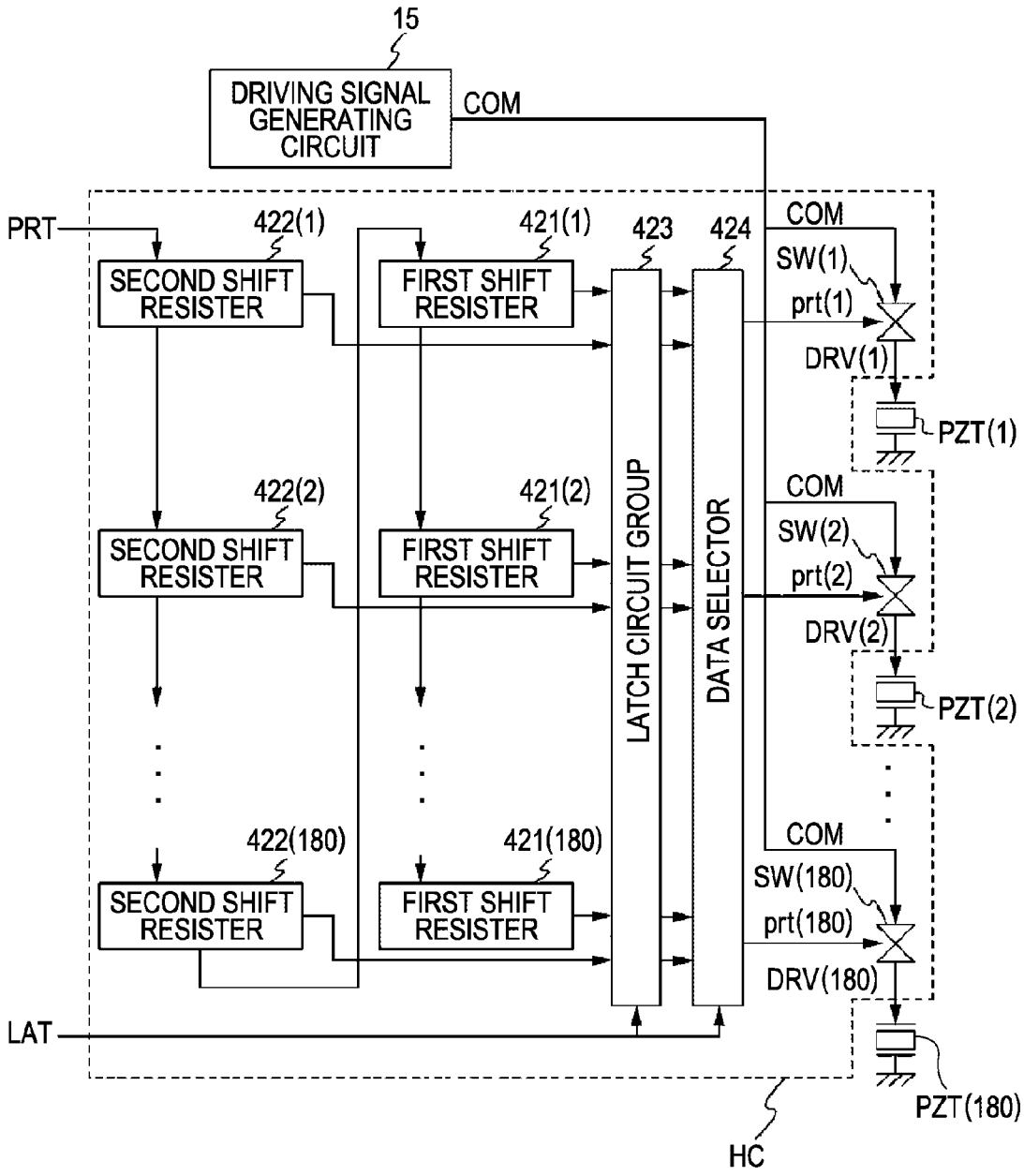
FIG. 4 is a view showing a head control unit.
Figure 5A:
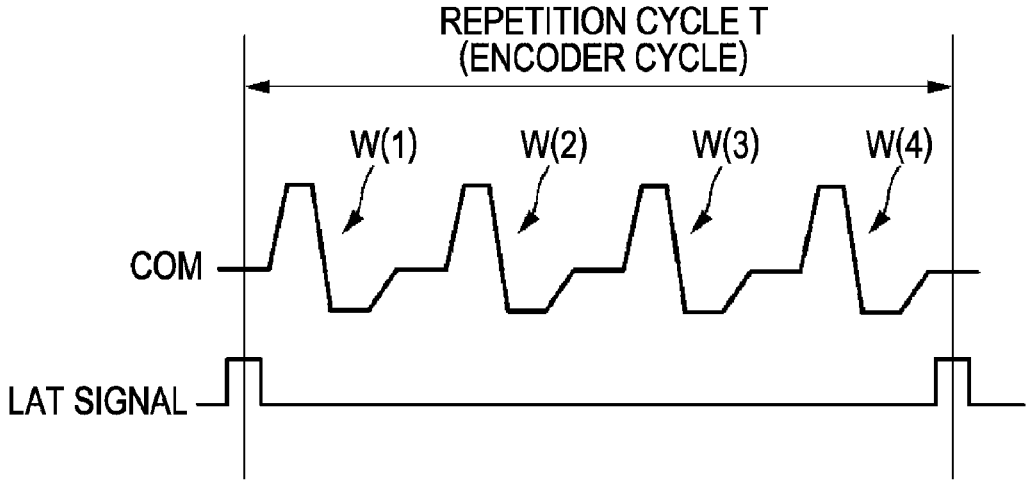
FIG. 5A is a view showing a driving signal.
Figure 5B:
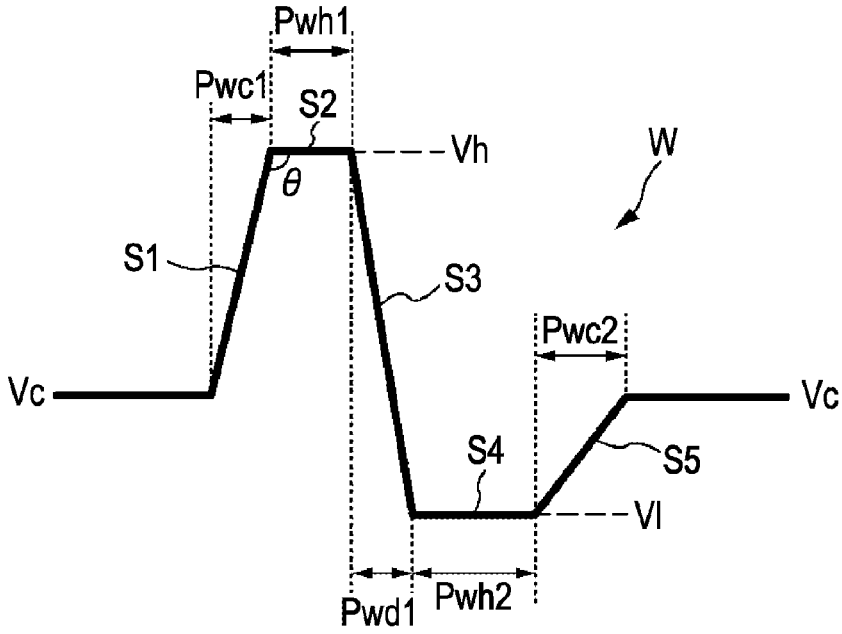
FIG. 5B is a view showing a driving waveform.

FIG. 3 is a view showing the driving signal generating circuit 15, and FIG. 4 is a view showing the head control unit HC. FIG. 5A is a view showing the driving signal COM, and FIG. 5B is a view showing the driving waveform W. In this embodiment, one driving signal generating circuit 15 is installed for one nozzle array (180 nozzles). For this reason, the driving signal COM generated from a certain driving signal generating circuit 15 is commonly used for the nozzles belonging in a certain nozzle array.

As shown in FIG. 3, the driving signal generating circuit 15 (corresponding to the driving signal generating unit) has a waveform generating circuit 151 and a current amplifying circuit 152. First, the waveform generating circuit 151 generates a voltage waveform signal (waveform information of analog signal) serving as a basis of the driving signal COM based on a DAC value (waveform information of digital signal). The current amplifying circuit 152 amplifies the current of the voltage waveform signal, and outputs it as the driving signal COM. In this instance, it is not limited to the generation of the driving signal COM based on the waveform information of the digital signal (the DAC value).

The current amplifying circuit 152 includes a rising transistor Q1 (an NPN transistor) which is operated at the time of voltage rising of the driving signal COM, and a falling transistor Q2 (a PNP transistor) which is operated at the time of voltage falling of the driving signal COM. In the rising transistor Q1, a collector is connected to a power source, and an emitter is connected to an output signal line of the driving signal COM. In the falling transistor Q2, a collector is connected to a ground (an earth), and an emitter is connected to an output signal line of the driving signal COM.

If the rising transistor Q1 is turned ON by the voltage waveform signal from the waveform generating signal 151, the voltage of the driving signal COM rises, so that charging of the piezoelectric element PZT is performed. Meanwhile, if the falling transistor Q2 is turned ON by the voltage waveform signal from the waveform generating signal 151, the voltage of the driving signal COM falls, so that discharging of the piezoelectric element PZT is performed. The driving signal generating circuit 15 generates the driving signal COM to produce the driving waveform W, of which voltage is varied, as shown in FIG. 5B.

Regarding the Head Control Unit HC

The head control unit HC includes 180 first shift resisters 421, 180 second shift resisters 422, a latch circuit group 423, a data selector 424, and 180 switches SW. Numerals enclosed by round brackets indicate the number of the nozzles corresponding to a member or signal.

First, a printing signal PRT is input to the 180 first shift resister 421, and then is input to the 180 second shift resisters 422. As a result, the serially transmitted printing signal PRT is converted into 180 printing signals PRT(i) of 2 bits. One printing signal PRT(i) is a signal corresponding to data of one pixel which is allocated to a i-th nozzle.

If a rising pulse of the latch signal LAT is input to the latch circuit group 423, 360 pieces of data of the respective shift resisters are latched to each of the corresponding latch circuits. When the rising pulse of the latch signal LAT is input to the latch circuit group 423, the rising pulse of the latch signal LAT is input to the data selector 424, so that the data selector 424 enters an initial state. The data selector 424 selects the printing signal PRT(i) of 2 bits corresponding to the respective i-th nozzles from the latch circuit group 423 prior to latch (prior to the initial state), and outputs a switch control signal prt(i) to the respective switches SW(i) in response to the respective printing signals PRT(i).

In accordance with the switch control signal prt(i), the On/OFF control of the switch SW(i) corresponding to the respective piezoelectric elements PZT(i) is performed. The ON/OFF operation of the switch applies or interrupts (DRV (i)) the driving waveform W generated by the driving signal COM which is transmitted from the driving signal generating signal 15 to the piezoelectric element, thereby ejecting the ink from the i-th nozzle or interrupting the ejection.

Regarding the Driving Signal COM

As shown in FIG. 5A, the driving signal COM of the embodiment uses four driving waveforms W with respect to one pixel (a unit region virtually defined on the paper). A period, in which a certain i-th nozzle ejects the ink droplets with respect to one pixel is referred to as "a repetition cycle T (corresponding to a cycle)". For this reason, in the driving signal COM, four driving waveforms W are generated in the repetition cycle T, and four driving waveforms W are repeatedly generated in every repetition cycle T. The four driving waveforms W have the same shape. They are referred to as a first waveform W(1), a second waveform W(2), a third waveform W(3) and a fourth waveform W(4) in turns from the driving waveform W which is firstly generated in the repetition cycle T.

In this embodiment, one pixel is represented by three grayscales: "large dot formation"; "small dot formation"; and "no dot". Accordingly, the printing signal PRT(i) for one pixel becomes 2-bit data. In the case of the "large dot formation", the switch control signal prt(i) is set so that all the four driving waveforms W(1) to W(4) are applied to the piezoelectric element. Similarly, in the case of the "small dot formation", the switch control signal prt(i) is set so that the two driving waveforms W(2) and W(3) are applied to the piezoelectric element. In the case of the "no dot", the switch control signal prt(i) is set so that the driving waveform W is not applied to the piezoelectric element. At that time, it is not limited such that two kinds of dots are formed, and, for example, one kind of dot may be formed by four driving waveforms. In this instance, one pixel is represented by two grayscales, that is, "dot present (all the four driving waveforms W are applied to the piezoelectric element)" and "no dot (the driving waveform W is not applied to the piezoelectric element)".

"The repetition cycle T" which is a period, in which a certain i-th nozzle ejects the ink droplets for one pixel, corresponds to a period in which a certain i-th nozzle (the head 41) moves by one pixel in the moving direction. The repetition cycle T is determined by the rising pulse of the latch signal LAT, as shown in FIG. 5A, and a period from a certain rising pulse to the next rising pulse in the latch signal LAT corresponds to the repetition cycle T. Here, the printing resolution of the moving direction is 180 dpi (1/180 inch), and the distance of one pixel in the moving direction is 180 dpi.

Further, a slit interval of the linear scale 51 (see FIG. 1B) to perform the position control of the head 41 in the moving direction is 180 dpi. That is, a time t from detection of a certain slit to detection of the next slit by the linear encoder is a time in which the head 41 moves at the slit interval (180 dpi) in the moving direction. In this instance, the linear encoder positioned at a rear side of the head 41 (the carriage 31) outputs the detected result of the slit of the linear scale 51 to the controller 10. In this way, the controller 10 can seize the position of the head 41 in the moving direction.

Since the slit interval is equal to the distance of one pixel in the moving direction, the time t (the encoder cycle) from detection of a certain slit to detection of the next slit by the linear encoder corresponds to the repetition cycle T. In this instance, the controller 10 produces the LAT signal based on the signal of the slit detected by the linear encoder. In this way, a period, in which a certain i-th nozzle belonging to the head 41 faces one pixel, may be set as the repetition cycle T. That is, the controller 10 produces the rising pulse of the LAT signal at the timing in which the linear encoder detects the slit, and generates four driving waveforms W(1) to W(4) for one pixel as the driving signal COM. Further, the controller 10 can calculate a moving velocity Vc (=180 dpi/t) of the head 41 in accordance with the slit detection signal from the linear encoder.

Regarding the Driving Waveform W

As shown in FIG. 5B, the driving waveform W includes "a first expansion element Sl" in which an electric potential rises from an intermediate potential Vc to the highest potential Vh, "a first hold element S2" in which the highest potential Vh is maintained, "a contraction element S3" in which the electric potential falls from the highest potential Vh to the lowest potential Vl, "a second hold element S4" in which the lowest potential Vl is maintained, and "a second expansion element S5" in which the electric potential rises from the lowest potential Vl to the intermediate potential Vc.

A generation time of the first expansion element Sl is referred to as "a first expansion time Pwc1", a generation time of the first hold element S2 is referred to as "a first hold time Pwh1", a generation time of the contraction element S3 is referred to as "a contraction time Pwd1", a generation time of the second hold element S4 is referred to as "a second hold time Pwh2", and a generation time of the second expansion element S5 is referred to as "a second expansion time Pwc2".

Figure 6:
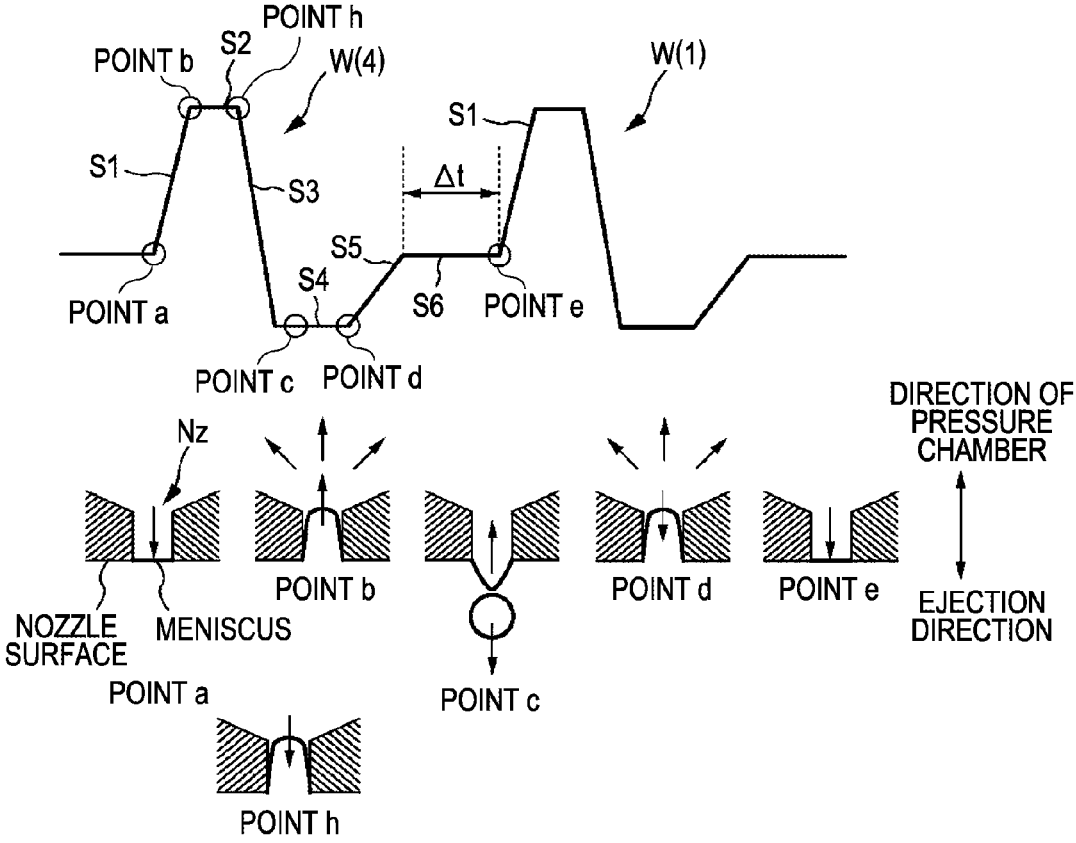
FIG. 6 is a view showing a relationship between the respective elements of the driving waveform and motion of a meniscus.

FIG. 6 is a view showing a relationship between the respective elements of the driving waveform W and motion of a meniscus (a free surface of the ink exposed from the nozzle) of the nozzle Nz. In the enlarged view of the nozzle Nz in the figure, a hatched portion corresponds to the head 41 (the nozzle plate 412*c*), a portion enclosed by a hatch and painted by a white color corresponds to an ink portion, and a thick line corresponds to a meniscus. Further, in the figure, a final driving waveform (the fourth waveform W(4)) in a previous repetition cycle T and an initial driving waveform (the first waveform W(1)) in the next repetition cycle T are shown.

First, after the third waveform W(3) (not shown) has been applied to the piezoelectric element in the previous repetition cycle T, the piezoelectric element is maintained in the state in which the intermediate potential Vc is applied. In this instance, when the piezoelectric element is not contracted and the intermediate potential Vc is applied to the piezoelectric element, the volume of the pressure chamber 412*d* is a reference volume. When the first expansion element S1 of the fourth waveform W(4) is applied to the piezoelectric element after the third waveform W(3) (point a), as shown in FIG. 6, the meniscus is flush with the nozzle surface.

If the first expansion element S1 of the fourth waveform W(4) is applied to the piezoelectric element, the piezoelectric element is contracted in a longitudinal direction, and the volume of the pressure chamber 412*d* is expanded. In this instance (point b), the meniscus is drawn towards the pressure chamber rather than the nozzle surface.

Next, the contracted state of the piezoelectric state is maintained by the first hold element S2, and thus the expanded state of the pressure chamber 412*d* is maintained. After that, if the contraction element S3 is applied to the piezoelectric element, the piezoelectric element is expanded from the contracted state without stopping, and the volume of the pressure chamber 412*d* is also contracted without stopping. The ink pressure in the pressure chamber 412*d* is drastically increased by the contraction of the pressure chamber 412*d*, and thus the ink droplets are ejected from the nozzles (point c). A meniscus surface, from which the ink droplets are separated, is drawn towards the pressure chamber by the reaction. Further, the extended state of the piezoelectric element and the contracted state of the pressure chamber 412*d* are maintained by the second hold element S4. Finally, if the second expansion element S5 is applied to the piezoelectric element, the volume of the pressure chamber 412*d* is returned to the reference volume.

Here, the second hold element S4 and the second expansion element S5 play a role of not only returning the volume of the pressure chamber 412*d* which is contracted to eject the ink droplets from the nozzles, to the reference volume, but also damping vibration of the meniscus which is caused by the ejection of the ink from the nozzles. That is, the second hold element S4 and the second expansion element S5 correspond to a damping element. More specifically, immediately after the ink droplets are ejected, the meniscus is drawn towards the pressure chamber. After the meniscus is drawn towards the pressure chamber as fat as possible, the moving direction of the meniscus is reversed, and then is again moved in the ejection direction. In this instance (point d), if the pressure chamber 412*d* is expanded by the second expansion element S5, negative pressure is created in the inside of the pressure chamber 412*d*, so that the moving force of the meniscus which tries to move in the ejection direction can be reduced. As a result, the vibration of the meniscus is damped.

That is, when the meniscus moved towards the pressure chamber (the drawing direction) after the ink ejection is again moved in the ejection direction, the second hold time Pwh2 may be adjusted so as to expand the pressure chamber 412*d*. Further, the vibration of the meniscus is followed by pressure vibration of the ink in the pressure chamber 412*d*, and the pressure vibration of the ink in the pressure chamber 412*d* is affected by an inherent vibration cycle Tc of the pressure chamber 412*d* filled with the ink. Consequently, the second hold time Pwh2 is preferably determined based on the inherent vibration cycle Tc of the pressure chamber 412*d*. More specifically, the moving direction of the meniscus is inversed by a half cycle (Tc/2) of the inherent vibration cycle Tc of the pressure chamber 412*d* (hereinafter, referred to as a vibration cycle Tc of the pressure chamber). For this reason, after the ink droplets are ejected and then the half time (Tc/2) of the vibration cycle Tc of the pressure chamber is lapsed, the second hold time Pwh2 is adjusted so as to apply the second expansion element S5 to the piezoelectric element. As a result, it is possible to damp the residual vibration (residual vibration created in the pressure chamber 412*d*) of the meniscus.

In this instance, the inherent vibration cycle Tc of the pressure chamber 412*d* (the pressure vibration of the ink in the pressure chamber 412*d*) can be expressed by Equation 1 below, as disclosed in JP-A-2003-11352;

$$Tc=2\pi\sqrt{[(Mn\times Ms)/(Mn+Ms)]\times Cc} \quad (1)$$

In Equation (1), Mn denotes inertance of the nozzle Nz, Ms denotes inertance of the ink supply channel 412*g*, and Cc denotes compliance (a volume variation per unit pressure; indicating a degree of softness) of the pressure chamber 412*d*.

In Equation (1), the term "inertance M" indicates mobility of the ink in the ink channel, and is mass of the ink per unit sectional area. Supposing that density of the ink is ρ, a sectional area of the surface perpendicular to a flow direction of the ink in the channel is S, and a length of the channel is L, the inertance M can be approximately expressed by Equation (2) below:

$$\text{inertance } M=(\text{density } \rho\times\text{length } L)/\text{sectional area } S \quad (2)$$

Further, without being limited to Equation (1) above, and a vibration cycle of the pressure chamber 412*d* is also possible.

Regarding the Frequency Characteristic

Figure 7A:
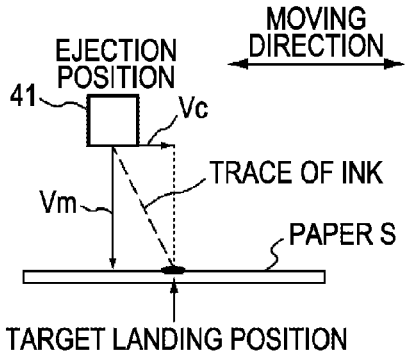
FIG. 7A is a view showing a shape of an ink droplet ejected from the moving head.

FIG. 7A shows the shape of the ink droplet ejected from the head 41 moving in the moving direction. In the printer 1 of the embodiment, as shown in FIG. 1B, the ink droplets are ejected from the head 41 moving in the moving direction. Since an inertial force acts on the ink droplet which is ejected from the head 41 moving in the moving direction, in the moving direction, as shown in FIG. 7A, the ink droplet lands on the paper at a position that is shifted in the moving direction of the head 41 from ejection position of the ink droplet. For this reason, it is necessary to eject the ink droplet from the head on the paper S at a position in front of a target landing position of the ink droplet. In other words, it is necessary to eject the ink droplet at timing earlier than the time that the head 41 arrives at the target landing position on the paper.

If the moving velocity Vc (corresponding to the relative moving velocity) of the head 41 is constant, the time of ejecting the ink droplet at timing earlier than the time that the head 41 arrives at the target landing position can be fixed. Consequently, the controller 10 of the printer 1 controls the carriage unit 30 in such a way that the head 41 moves at a constant "reference head velocity Vcs".

Figure 7B:
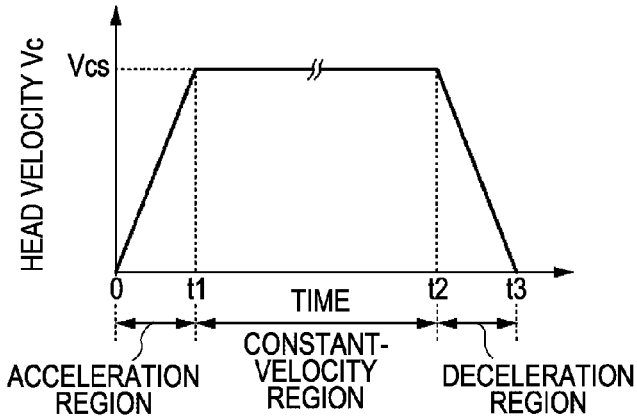
FIG. 7B is a view showing a variation of a moving velocity of the head.

FIG. 7B is a view showing a variation of the moving velocity Vc of the head 41 (the carriage 31). A transverse axis of FIG. 7B indicates a time after the head 41 starts to move, and a vertical axis of FIG. 7B indicates moving velocity Vc of the head 41. The controller 10 moves the head 41 at the reference head velocity Vcs. As shown in the figure, however, during a period (acceleration region; time t0 to time t1) in which the velocity Vc of the head gradually accelerates to the reference head velocity Vcs after the head 41 starts to move and a period (deceleration region; time t2 to time t3) tin which the velocity gradually decelerates from the reference head velocity Vcs to the time that the head 41 stops, the velocity Vc of the head is slower than the reference head velocity Vcs.

That is, a period (the repetition cycle T), in which the head 41 moves by one pixel in the acceleration region and the deceleration region (hereinafter, the acceleration and deceleration region) is different from a period, in which the head 41 moved by one pixel in a constant-velocity region (time t1 to t2) which is the constant reference head velocity Vcs. For this reason, the ejection positions (the ejection timing) of the ink droplets with respect to the target landing position are different in the acceleration and deceleration region and the target landing position. If the ejection positions of the ink droplets with respect to the target landing position (a target pixel) are constant, irrespective of the moving velocity Vc of the head 41, and four driving waveforms (W1) to W(4) for one pixel are repeatedly generated every constant repetition cycle T, the dot formation positions are deviated from the target landing position, so that the image quality is deteriorated.

It is possible to causes the ejection position of the ink droplets with respect to the target landing position to be constant by using only the constant-velocity region, without using the acceleration and deceleration region. By not using the acceleration and deceleration region, the printing region is narrowed or the printing time is prolonged. For this reason, the printing is performed by using the acceleration and deceleration region in this embodiment.

As described above, in this embodiment, the slit interval of the linear scale 51 (FIG. 1B) corresponds to the distance (180 dpi) of one pixel in the moving direction. The controller 10 enables the linear encoder attached to the rear side of the carriage 31 (the head 41) to generate the LAT signal in response to the signal from the linear scale 51 detecting the slit, and the repetition cycle T is determined in accordance with the rising pulse of the LAT signal. That is, at the timing that the linear encoder detects the slit, four driving waveforms W for one pixel are generated in the driving signal COM.

For this reason, similar to the acceleration and deceleration region, when the head velocity Vc is slow, the time interval in which the linear encoder detects the slit is prolonged, and thus the timing that the driving waveform W for one pixel is generated is delayed. In this way, even though the head velocity Vc is slow and thus the time of which the head passes through one pixel is long, the dot can be formed at the target pixel. By contrast, similar to the constant-velocity region, when the head velocity Vc is fast, the time interval in which the linear encoder detects the slit is shortened, and the timing in which the driving waveform W occurs for one pixel becomes fast. In this way, since the head velocity Vc is fast, the dot can be formed at the target pixel, even though the time the head passes through one pixel is shortened.

Figure 7C:
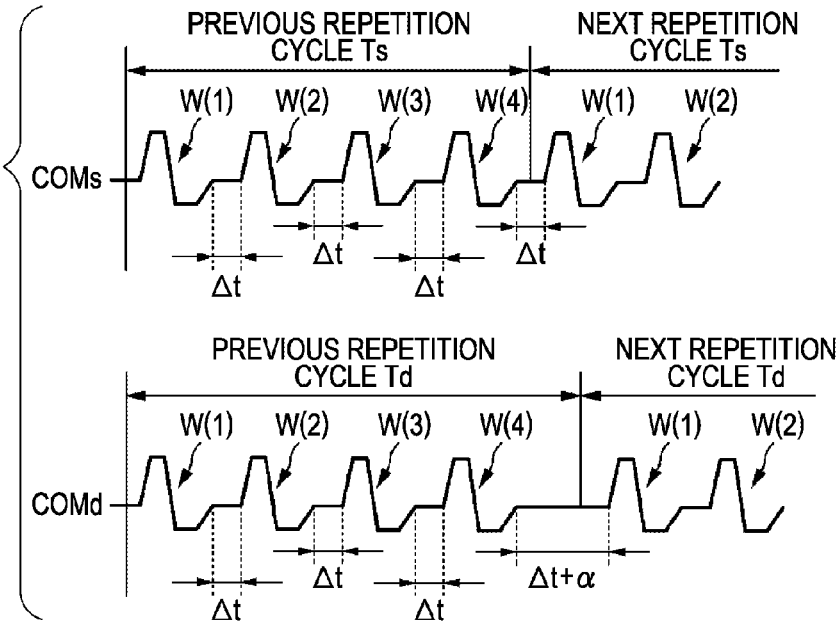
FIG. 7C is a view showing a difference between a driving signal in a constant-velocity region and a driving signal in an acceleration and deceleration region.

FIG. 7C is a view showing a difference between the driving signal (COMs) in the constant-velocity region and the driving signal (COMd) in the acceleration and deceleration region. The repetition cycle Ts of the driving signal COMs in the constant-velocity region is shorter than the repetition cycle Td of the driving signal COMd in the acceleration and deceleration region. Here, at the time of the designing of the driving waveform W, a parameter (e.g., Pwc1 or the like) for forming the driving waveform W or a waveform interval Δt of the driving waveform W (standby time of the driving waveform W) are determined on the basis of the repetition cycle Ts of the constant-velocity region.

For this reason, in the driving signal COMs of the constant-velocity region, since the waveform interval Δt of four driving waveforms W(1) to W(4) in the repetition cycle T are equal, four driving waveforms W are placed with good balance. Meanwhile, since four driving waveforms W for one pixel are generated at a predetermined waveform interval Δt on the basis of the rising pulse of the latch signal LAT, the driving waveforms W for one pixel are unevenly generated at an early stage of the repetition cycle T in the driving signal COMd of the acceleration and deceleration region. As shown in the figure, in the driving signal COMd of the acceleration and deceleration region, a waveform interval Δt+α between the final driving waveform (the fourth waveform W(4)) in the previous repetition cycle T and the initial driving waveform (the first waveform W(1)) in the next repetition cycle T is different from the waveform interval Δt of other driving waveforms W(1) to W(3), and is different from the interval Δt between the fourth waveform W(4)) and the first waveform W(1)) in the driving signal COM of the constant-velocity region.

Figure 8:
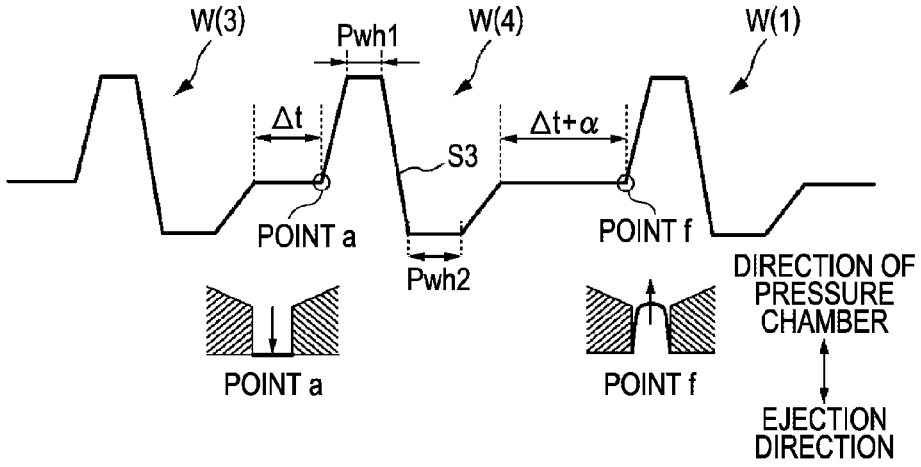
FIG. 8 is a view showing a state in which an interval between a final driving waveform and an initial driving waveform is different from a design value.

FIG. 8 is a view showing the state in which the waveform interval Δt+α between the final driving waveform W(4) in the repetition cycle T and the initial driving waveform W(1) in the next repetition cycle T is different from the waveform interval Δt of the design value. In the figure, the driving waveform W is a driving waveform W of the acceleration and deceleration region. The waveform interval Δt between the third waveform W(3) and the fourth waveform W(4) in the previous repetition cycle T is the interval Δt of the design value, but the waveform interval Δt+α between the final fourth waveform W(4) in the previous repetition cycle T and the first waveform W(1) in the next repetition cycle T is longer than the waveform interval Δt of the design value.

As shown in FIGS. 6 and 7C, the waveform interval Δt between the driving waveforms W (a design driving waveform W) is constant in the constant-velocity region, and a meniscus state is constant at the start time of application (point a and point e) of the driving waveforms W(4) and W(1). The term "meniscus state" means a position of the meniscus and a moving direction (a direction of the pressure vibration on the ink in the pressure chamber and a direction of force acting on the ink in the pressure chamber) of the meniscus with respect to the nozzle surface. If the meniscus state is constant at the start time of application of the driving waveform W, the ejection characteristic of the ink droplets can be constant when the same driving waveform W is applied.

As described in FIG. 6, the residual vibration of the meniscus by the ejection of the ink droplets is damped by the second hold time Pwh2 and the second expansion time Pwc2 of the driving waveform W, but in the state in which the residual vibration of the meniscus is not completely settled, there is a case in which the next driving waveform W is applied. If the interval Δt of the driving waveform W is not constant, it is not able to make the meniscus state uniform at the start time of application of the driving waveform W.

Accordingly, as described above, the driving waveform W is designed so that the waveform interval Δt of the driving waveforms W is constant on the basis of the repetition cycle Ts of the constant-velocity region in the designing process of the driving waveform W. Further, it is not limited such that the waveform interval Δt of the driving waveforms W(1) to W(4) in the same repetition cycle T is uniformed and the interval Δt of the driving waveforms W(4) and W(1) on a border line of the repetition cycle T is also uniformed. In this way, the meniscus state at the start time of application of the driving waveforms W(1) to W(4) for the same repetition cycle T and the meniscus state at the start time of application of the driving waveforms W for different repetition cycle T can be equalized, thereby stabilizing the ink ejection characteristic. In this instance, the meniscus state is aligned at the start time of application of the waveform W in order to put the meniscus and the nozzle surface at the same position and enable the force to act on the meniscus to move in the ejection direction at the start time of application of the driving waveforms W in this embodiment.

As shown in FIGS. 7C and 8, however, since the repetition cycle Td of the acceleration and deceleration region is slower than the design repetition cycle Ts (the repetition cycle Ts of the constant-velocity region), the waveform interval Δt+α between the final driving waveform W(4) in the previous repetition cycle T and the initial driving waveform W(1) in the next repetition cycle T is longer than the design waveform interval Δt. For this reason, in the case in which the first waveform W(1) is applied while the residual vibration of the meniscus due to the ink ejection of the fourth waveform W(4) is not completely damped, as shown in FIG. 8, there is a case in which the meniscus state at the start time (point f) of application of the first waveform W(1) is different from the meniscus state determined in the design process.

As shown in FIG. 8, the interval between the third waveform W3 and the fourth waveform W4 is the design interval Δt. At the start time (point a) of application of the fourth waveform W4, the meniscus and the nozzle surface are placed at the same position, and the force acts on the meniscus to move in the ejection direction. By contrast, since the waveform interval Δt+α between the fourth waveform W(4) and the first waveform is longer than the design waveform interval Δt, at the start time (point f) of application of the first waveform W(1), the meniscus is placed at a direction of the pressure chamber side farther than the nozzle surface, and the force acts on the meniscus to move in the direction of the pressure chamber. In this way, if the interval Δt of the driving waveforms W is different, there is a case in which the meniscus state is different at the start time of application of the next driving waveform W. If the meniscus state is different at the start time of application of the driving waveform W, even though the same driving waveform W is applied, the ejection characteristic of the ink droplets is varied.

Figure 9:
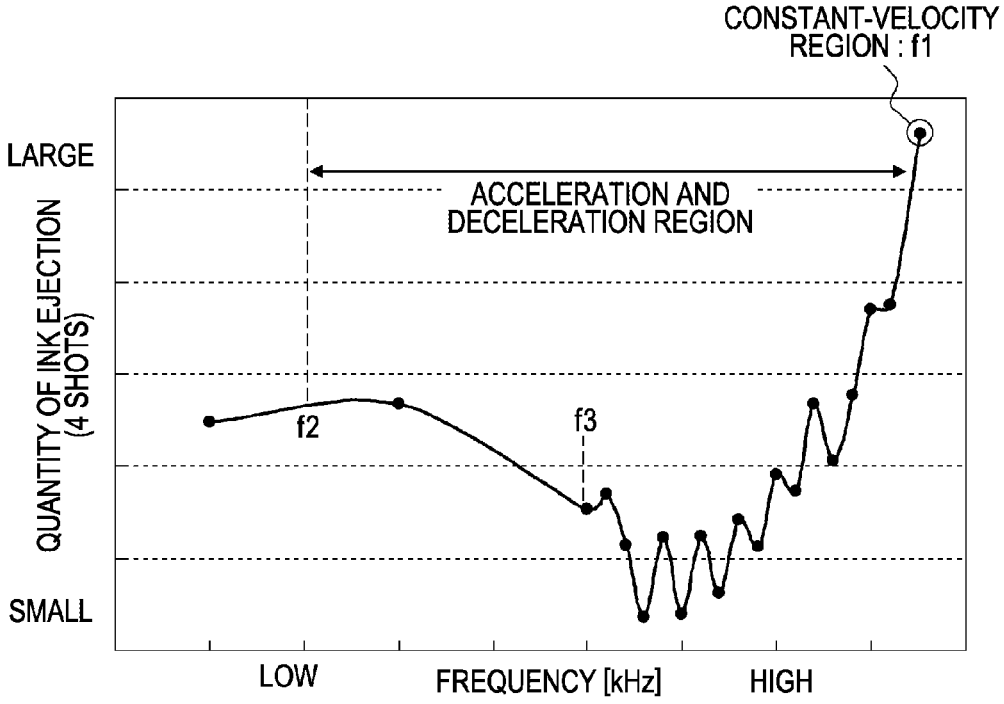
FIG. 9 is a view showing a relationship between a frequency of a driving waveform and a quantity of ink ejection.

FIG. 9 is a view showing a relationship between the frequency of the driving waveform W(1) to W(4) and a quantity of the ink ejection for one pixel. A transverse axis of a graph indicates a frequency f (=1/repetition cycle T) of four driving waveforms W(1) to W(4) for one pixel, in which the frequency f is increased towards a right side of the transverse axis. A vertical axis of the graph indicates the amount of the ink ejected from the nozzles in response to four driving waveforms W(1) to W(4) for one pixel, in which the quantity of the ink ejection is increased towards an upper portion of the vertical axis. The changing of the frequency f of the driving waveforms W for one pixel means the changing of the length of the repetition cycle T which produces four driving waveforms W(1) to W(4). At the measurement of FIG. 9, the length of the repetition cycle T is changed by generating four driving waveforms W(1) to W(4) at the design waveform interval Δt in accordance with the start of the repetition cycle T and adjusting the time after the final fourth waveform W(4). For this reason, as the frequency f is high, the repetition cycle T is short, and thus the interval between the fourth waveform W(4) and the first waveform W(1) of the next repetition cycle T is shortened. As the frequency f is low, the repetition cycle T is long, and thus the interval between the fourth waveform W(4) and the first waveform W(1) of the next repetition cycle T is prolonged.

From the measurement results in FIG. 9, it can be seen that the quantity of the ink ejection is varied as the frequency f of the driving waveform W for one pixel is changed. Further, when the frequency f is high, the variation in the quantity of the ink ejection is equally high according to the change of the frequency f. In particular, after the frequency f3 in FIG. 9, the quantity of the ink ejection is significantly varied according to the change of the frequency f. Further, the quantity of the ink ejection exerts influence on a velocity Vm of the ink ejection. For this reason, from the fact that the quantity of the ink ejection is varied according to the change of the frequency f, it can be supposed that the velocity Vm of the ink ejection is also varied according to the change of the frequency f. The reason why this phenomenon happens seems to be that the waveform interval between the final driving waveform W(4) in the previous repetition cycle T and the initial driving waveform W(1) in the next repetition cycle T is changed by varying the frequency f of the driving waveform W, so that the meniscus state (the position of the meniscus and direction of the force) is changed at the start time of application of the initial driving waveform W(1).

In addition, in the case that the frequency f of the driving waveform W is low (e.g., in the vicinity of the frequency f2 in FIG. 9), since the waveform interval between the driving waveforms W(4) and W(1) of the different repetition cycle T is long, the residual vibration of the meniscus due to the ink ejection is damped until the start time of application of the initial driving waveform W(1) of the next repetition cycle T, so that the meniscus state is stable irrespective of the waveform interval. For this reason, in the region of the low frequency f, it seems that the fluctuation of the ejection characteristic is small even though the frequency f is varied. By contrast, in the region of the high frequency f, it seems that the waveform interval between the driving waveforms W(4) and W(1) of the different repetition cycle T is short, and since the next driving waveform W(1) is applied when the residual vibration of the meniscus is generated, the meniscus state of the next driving waveform W(1) is significantly different, so that the ejection characteristic is dramatically varied.

That is, if the frequency f of the driving waveform W is lowered by setting the head velocity Vc low, the ejection characteristic of the ink droplets is likely to be stabilized even though the frequency f is varied by the change of the head velocity Vc. However, it is preferable that since a demand for high-speed printing is increased, the head velocity Vc is increased as high as possible. For this reason, the head velocity Vcs of the constant-velocity region is set to be fast, and thus the frequency f of the driving waveform W in the constant-velocity region becomes high. Then, the frequency f of the driving waveform W in the acceleration and deceleration region becomes high, and if the head velocity Vc in the acceleration and deceleration region is changed, the ejection characteristic of the ink droplets is dramatically changed. In the printer 1 according to the embodiment, the frequency f of the constant-velocity region becomes "f1" in the figure, and the frequency f of the acceleration and deceleration region is equal to or more than f2 and less than f1 in the figure.

As such, if the velocity (the reference head velocity Vcs) of the constant-velocity region is set to be fast, the frequency f of the acceleration and deceleration region, in which the head velocity Vc is changed, becomes high. As shown in the measurement results in FIG. 9, the ejection characteristic (the quantity of the ink ejection and the velocity Vm of the ink ejection) of the ink droplets is highly varied according to the change of the head velocity Vc. If the ejection characteristic of the ink droplets is varied, the image quality is deteriorated.

Accordingly, an object of the embodiment is to suppress a fluctuation of the ejection characteristic of the ink droplets according to the change of the head velocity Vc (the variation of the frequency of the driving waveform W). In this instance, with the variation of the frequency of the driving waveform W, it is not limited only to changing the quantity of the ink or the velocity Vm of the ink ejection, but, for example, the occurrence of satellite (fine ink droplets) may also be changed.

Regarding the Correction of the Driving Waveform W

Figure 10A:
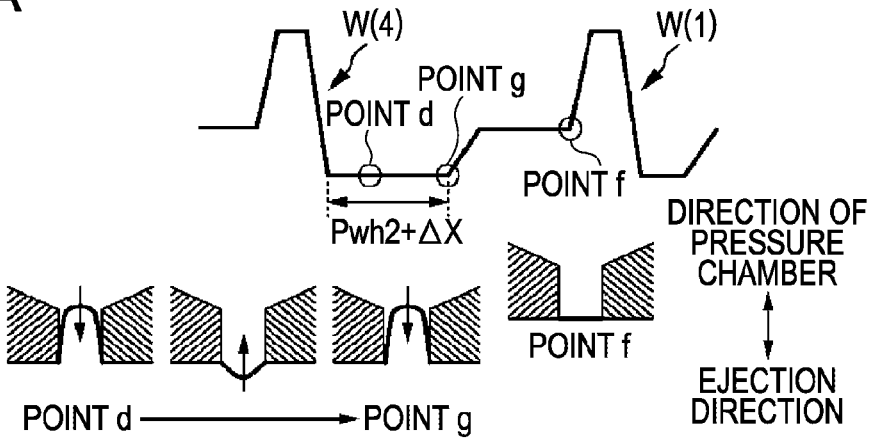
FIGS. 10A to 10C are views showing a shape of the final driving waveform to be corrected.
Figure 10B:
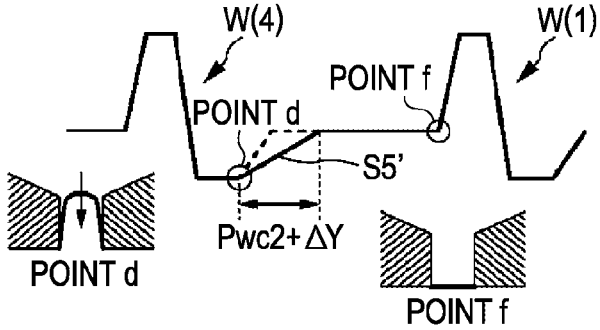
Figure 10C:
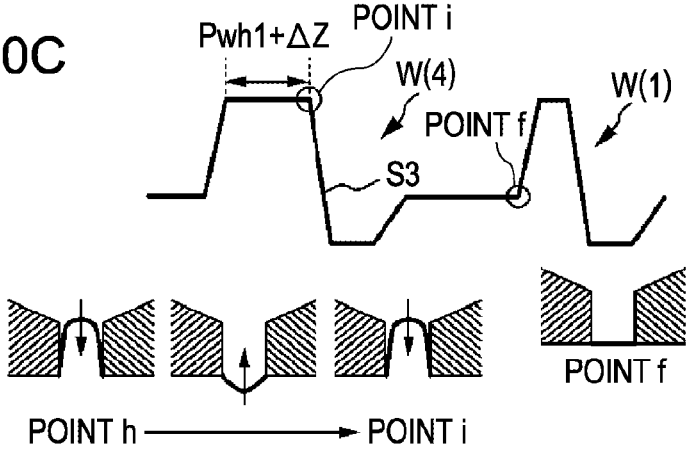

FIGS. 10A to 10C are views of the shape of the final driving waveform (the fourth waveform W(4)) to be corrected in the repetition cycle T. In the description below, four driving waveforms W(1) to W(4) are applied to the piezoelectric element for the consecutive repetition cycle T. As described above, if the head velocity Vc in the acceleration and deceleration region is changed, and thus the waveform interval Δt+α between the final driving waveform (the fourth waveform W(4)) in the previous repetition cycle T and the initial driving waveform (the first waveform W(1)) in the next repetition cycle T is longer than the reference waveform interval Δt, the meniscus state (the position of the meniscus and the direction of the power) at the start time (the point f in FIG. 8) of application of the first waveform W(1) is different from the meniscus state at the start time of application of other driving waveform W, so that the ejection characteristic of the ink droplets is varied. The meniscus state at the start time of application of the initial driving waveform W(1) for the next repetition cycle T is affected by the meniscus state after the ink ejection by the driving waveform W previously applied, that is, the final driving waveform W(4) for the previous repetition cycle T.

Accordingly, in this embodiment, by correcting only the parameter for forming the final driving waveform (the fourth waveform W(4)) in the repetition cycle T, the meniscus state when the final driving waveform (the first waveform W(1)) for the next repetition cycle T is applied is equalized to the meniscus state at the start time of application of other driving waveform W, thereby preventing the fluctuation of the ejection characteristic (the quantity of the ink ejection) of the ink droplets.

This fact, in that only the final driving waveform W(4) in the repetition cycle T is corrected and other driving waveforms W(1) to W(3) are not corrected except for the final driving waveform W(4), means that the waveform interval Δt between other driving waveforms W(1) to W(3) becomes the design waveform interval Δt (the interval Δt of the driving waveforms W for the constant-velocity region). For this reason, the residual vibration of the meniscus generated at the ink ejection by other driving waveforms W(1) to W(3) is not changed, and the meniscus state at the start time of application of the later driving waveforms W(2) to W(4) is stabilized. As a result, the fluctuation of the ejection characteristic according to the change of the head velocity Vc is easily corrected by correcting only the final driving waveform W(4) in the repetition cycle T, and thus the process of correcting becomes easy.

The correction is performed not for the final driving waveform W(4), for example, but the third waveform W(3) in the repetition cycle T. In this instance, the interval between the final fourth waveform W(4) and the initial first waveform W(1) in the next repetition cycle T is adjusted by correcting the parameter of the third waveform W(3), so that it is necessary to adjust the meniscus state at the start time of application of the first waveform W(1). However, since the parameter of the third waveform W(3) is corrected so as to adjust the meniscus state at the start time of application of the first waveform W(1), the waveform interval between the third waveform W(3) and the fourth waveform W(4) is deviated by the design waveform interval Δt, so that the meniscus state at the start time of application of the fourth waveform W(4) may be displaced. For this reason, in order to adjust the meniscus state at the start time of application of the initial waveform W(1) in the next repetition cycle T in the driving waveforms W(1) to W(3) of the repetition cycle T, except for the final driving waveform in the repetition cycle T, it is necessary to adjust the meniscus state at the start time of application of the driving waveform W positioned between the driving waveforms W(1) to W(3) and the initial driving waveform W(1), except for the final driving waveform adjusting the parameter, and thus the process of correcting the driving waveform W is complicated. Further, it is difficult to make the meniscus state uniform at the start time of application of all the driving waveforms W(1) to W(4). Consequently, only the final driving waveform W(4) in the repetition cycle T is corrected in this embodiment.

FIG. 10A is a view showing a shape of "the second hold time Pwh2" to be corrected of the final driving waveform W(4). For example, it seems that the second hold time Pwh2 of the final driving waveform W(4) is corrected to be "Pwh2+ΔX" long by the correction value ΔX. As described above, when the meniscus drawn towards the pressure chamber after the ejection of the ink droplets again moves in the ejection direction (point d in FIG. 6), it is possible to damp the residual vibration of the meniscus by applying the second expansion element S5. For this reason, the second hold time Pwh2 is adjusted to be longer by the correction value ΔX, and the meniscus state at the start time (the point f) of application of the first waveform W(1) is corrected to be equal to the meniscus state at the start time of application of other driving waveforms W(2) to W(4). It is considered that the pressure chamber 412*d* is expanded by the second expansion element S5 when the meniscus moves in the ejection direction (the point g in FIG. 10A) after the ink is ejected by the final driving waveform W(4).

In this way, while the residual vibration after the ink ejection by the final driving waveform W(4) in the previous repetition cycle T is damping, the ejection characteristic of the ink droplets by the initial driving waveform W(1) in the next repetition cycle T can be stabilized. In this instance, since the residual vibration of the meniscus after the ejection of the ink droplets is affected by the vibration cycle Tc of the pressure chamber, the correction value ΔX of the second hold time Pwh2 may be determined by referring to the vibration cycle Tc of the pressure chamber.

FIG. 10B is a view showing a shape of "the second expansion time Pwc2" to be corrected of the final driving waveform W(4). For example, the second expansion time Pwc2 is corrected to be longer by a correction value ΔY, and the waveform interval of the driving waveforms W in a different repetition cycle T is adjusted, so that the meniscus state at the start time (the point f) of application of the first driving waveform W(1) in the next repetition cycle T is adjusted to be equal to the meniscus state at the start time of application of other driving waveforms W(2) to W(4). Further, even though the second expansion time Pwc2 is corrected to be longer, the force acts on the meniscus in the ejection direction at "the point d" of the final driving waveform W(4) in the previous repetition cycle T. Therefore, the residual vibration of the meniscus due to the ink ejection of the final driving waveform W(4) is damped by applying the second expansion element S5' at the timing of the point d.

In this way, among the parameters for forming the final driving waveform W(4) in the previous repetition cycle T, by correcting the second hold time Pwh2 (FIG. 10A) or the second expansion time Pwc2 (FIG. 10B), the meniscus state may be adjusted at the start time of application of the first waveform W(1) in the next repetition cycle T. The second hold time Pwh2 and the second expansion time Pwc2 are "a damping element" for damping the residual vibration of the meniscus due to the ink ejection, and are applied to the piezoelectric element after the ejection of the ink droplets. That is, even though the second hold time Pwh2 or the second expansion time Pwc2 is corrected, it does not affect the ejection characteristic of the ink droplets by the final driving waveform W(4) in the repetition cycle T. That is, since the damping elements (Pwh2 and Pwc2) of the final driving waveform W(4) are corrected, it does not affect the ejection characteristic of the final driving waveform W(4), and it can suppress the fluctuation of the ejection characteristic of the initial driving waveform W(1) in the next repetition cycle T.

FIG. 10C is a view showing a shape of "the first hold time Pwh1 (corresponding to the hold element)" to be corrected of the final driving waveform W(4). It is not limited such that only the damping elements (Pwh2 and Pwc2) of the final driving waveform W(4) are corrected, as described above, and, for example, it is possible to correct "the first hold time Pwh1" of the final driving waveform W(4) which affects the ejection of the ink droplets. As shown in the figure, the first hold time Pwh1 of the final driving waveform W(4) is corrected to be "Pwh1+ΔZ" long by a correction value ΔZ, the meniscus state at the start time (the point f) of application of the initial driving waveform W(1) is adjusted to be equal to the meniscus state at the start time of application of other driving waveforms W(2) to W(4).

The pressure chamber 412*d* is dramatically expanded by the first expansion element S1 of the driving waveform W, and then, the pressure chamber 412*d* is maintained in the expanded state by the first hold element S2. Even though the same highest potential Vh is applied to the piezoelectric element for the first hold time Pwh1, since the pressure chamber 412*d* has been previously dramatically expanded by the first expansion element S1, the pressure vibration, that is, the residual vibration due to the first expansion element S1, is generated in the ink in the pressure chamber 412*d*. For this reason, for example, in the residual vibration of the first expansion element S1, the ejection characteristic of the ink droplets is different in the case in which the contraction element S3 is applied when the force acts in the direction of the pressure chamber (in the expansion direction of the pressure chamber 412*d*) and the case in which the contraction element S3 is applied when the force acts in the ejection direction (in the contraction direction of the pressure chamber 412*d*). That is, the meniscus state is changed by the length of the first hold time Pwh1, so that the ejection characteristic of the ink droplets is varied. For this reason, since the first hold time Pwh1 after application of the first expansion element S1 is constantly maintained, the meniscus state when the contraction element S3 is applied can be constantly maintained, and thus the ejection characteristic of the ink droplets can be stabilized.

For example, suppose that in the state in which the meniscus state at the point (the point h in FIG. 6), to which the contraction element S3 in the design driving waveform W(4) is applied, for example, is mostly drawn towards the pressure chamber with respect to the nozzle surface, the force acts in the ejection direction. In this instance, in the state in which the meniscus state of the initial driving waveform W(1) in the next repetition cycle T is balanced by correcting the first hold time Pwh1 of the final driving waveform W(4) of the repetition cycle T and in which the meniscus state when the contraction element S3 is applied (the point i in FIG. 10C) is mostly drawn towards the pressure chamber with respect to the nozzle surface, similar to the point h in FIG. 6, the first hold time Pwh1 may be corrected so that the force acts in the ejection direction. In this way, the ejection characteristic of the final driving waveform W(4) in the repetition cycle T can be stabilized, and the ejection characteristic of the initial driving waveform W(1) in the next repetition cycle T can be also stabilized. In this instance, since the residual vibration of the meniscus by the first expansion element S1 is affected by the vibration cycle Tc of the pressure chamber, the correction value ΔZ of the first hold time Pwh1 may be determined by referring to the vibration cycle Tc of the pressure chamber.

That is, the meniscus state at the start time of application of the initial waveform W(1) is adjusted to be equal to the meniscus state of the other driving waveform W by changing the length of the first hold time Pwh1 using the correction value ΔZ, and the first hold time Pwh1 is adjusted so that the meniscus state at the end time of application of the first hold time Pwh1+ΔZ after the correction is equal to the meniscus state at the end time of application of the first hold time Pwh1 of the other driving waveform W.

In this instance, it is not limited such that the first hold time Pwh1 among the elements related to the ink ejection of the final driving waveform W(4) in the repetition cycle T is corrected, and, for example, the first expansion time Pwc1 (corresponding to the expansion element) may be corrected. Further, it is not limited such that any one of the parameters for forming the final driving waveform W(4) is corrected, and both of the second hold time Pwh2 and the second expansion time Pwc2 may be corrected. Further, although the parameters (Pwh2, Pwc2 or Pwh1) of the final driving waveform W(4) are corrected to be long in FIGS. 10A to 10C, it is not limited thereto, and it may be corrected to be short.

FIG. 11 is a table showing the correction value ΔX of the second hold time Pwh2 to the head velocity Vc. The correction values (ΔX, ΔY and ΔZ) of the parameters (Pwh2, Pwc2 or Pwh1) of the final driving waveform W(4) shown in FIGS. 10A to 10C can be calculated by simulation or experiment. A case in which a correction value ΔX regarding the second hold time Pwh2 of the final driving waveform W(4) is calculated will be described as an example of the way of calculating the correction value ΔX.

First, "a certain frequency f-1" of four driving waveforms W(4) for one pixel, in other words, the length of "a certain repetition cycle T-1", in which four driving waveforms W(4) are generated, is set, and a driving signal COM-1 generating the four driving waveforms W(1) to W(4) is generated every the repetition cycle T-1 is generated. For this reason, the waveform interval Δt−1 between the final driving waveform W(4) in the previous repetition cycle T-1 and the initial driving waveform W(1) in the next repetition cycle T-1 is made uniform. By variously changing the second hold time Pwh2 of the final driving waveform W(4) in the repetition cycle T-1 in the driving signal COM-1, the quantity of the ink ejected from four driving waveforms W(1) to W(4) is measured.

In this way, in a certain frequency f-1 (a certain repetition cycle T-1), a relationship between the length of the second hold time Pwh2 and the quantity of the ink ejection, that is, the result of a varied quantity of the ink ejection to the variation of the second hold time Pwh2 can be obtained. From the relationship between the length of the second hold time Pwh2 and the quantity of the ink ejection, a length of the second hold time Pwh2−1 corresponding to the predetermined quantity of the ink ejection can be determined. If the length of the second hold time Pwh2 of the final driving waveform W(4) in a certain frequency f-1 is corrected to be a length of the second hold time Pwh2−1 corresponding to the predetermined quantity of the ink ejection, the quantity of the ink ejection can be stabilized. That is, a difference between the second hold time Pwh2−1 corresponding to the predetermined quantity of the ink ejection and the design second hold time Pwh2 corresponds to the correction value ΔX of the second hold time Pwh2 in a certain frequency f-1.

Similarly, by variously changing only the second hold time Pwh2 of the final driving waveform W(4) in the repetition cycle T-2 in the driving signal COM-2 which is a different frequency f-2 (repetition cycle T-2), the quantity of the ink ejected from four driving waveforms W(1) to W(4) is measured. In this way, the correction value ΔX of the second hold time Pwh2 in a certain frequency f-2 is calculated based on the relationship between the length of the second hold time Pwh2 and the quantity of the ink ejection.

As such, the correction value ΔX of the second hold time Pwh2 can be determined with respect to a plurality of frequencies f of four driving waveforms W. In this instance, the frequencies f of four driving waveforms W for one pixel are determined based on the repetition cycle T, and the repetition cycle T (the time of which the head 41 moves along a length of one pixel) is determined based on the moving velocity Vc of the head 41. For this reason, as shown in FIG. 11, the moving velocity Vc of the head 41 can correspond to the correction value ΔX of the second hold time Pwh2.

For example, according to the correction value table of FIG. 11, in the case in which the head velocity Vc is equal to or more than 0 and less than Vc(1), such as immediately after the head 41 starts to move in the acceleration and deceleration region or just before the head 41 stops, the ejection characteristic of the ink droplets can be stabilized by correcting the second hold time Pwh2 of the final driving waveform W(4) to "ΔX(1)". Further, since the head velocity Vc in the acceleration and deceleration region is changed from a velocity 0 to the reference head velocity Vcs, the correction value ΔX corresponding to the velocity 0 to the reference head velocity Vcs are set in the correction value table.

Modified Example

FIG. 12A is a view showing the driving signal COMd(1) of which only the final driving waveform W(4) in the previous repetition cycle Td is corrected, and FIG. 12B is a view showing the driving signal COMd(2) of which all the driving waveforms W(1) to W(4) in the previous repetition cycle Td are corrected. In FIGS. 12A and 12B, the second hold time Pwh2 of the driving waveform W is corrected. In the above-described embodiment, although only the final driving waveform W(4) in the previous repetition cycle Td is corrected, it is not limited thereto. For example, all the driving waveforms W(1) to W(4) of the previous repetition cycle Td may be corrected, or any one of three driving waveforms W(1) to W(3) may be corrected. Since the residual vibration of the meniscus due to the ink ejection of the final driving waveform W(4) has an effect on the meniscus state at the start time of application of the initial driving waveform W(1) in the next repetition cycle T, the ejection characteristic of the ink droplets is thus varied. Therefore, the final driving waveform W(4) is corrected.

As shown in FIG. 12A, if only the final driving waveform W(4) is corrected, the driving waveforms W(1) to W(4) are generated closer to one side at the start time of the repetition cycle Td. In this instance, the dots are formed closer to one side of one pixel in the moving direction. In the case in which all the driving waveforms W(1) to W(4) are corrected, as well as the final driving waveform W(4), four driving waveforms W(1) to W(4) are generated at relatively uniform time intervals in the repetition cycle Td. For this reason, it is possible to prevent the dots from being formed closer to one side of the pixel by correcting the driving waveform W, other than the final driving waveform W(4), so that the dots can be formed at a relative center of the pixel.

In FIG. 12B, for the purpose of illustration, the correction values ΔXa for the second hold time Pwh2 of all the driving waveforms W(1) to W(4) are equalized. However, in practice, by adjusting the parameters of all the driving waveforms W in line with various lengths of the repetition cycle Td which are varied by the head velocity Vc, it is difficult to make the meniscus state uniform at the start time of application of four driving waveforms W(1) to W(4) and the first waveform W(1) in the next repetition cycle T. It seems that the meniscus state is displaced at the start time of application of other driving waveforms W by correcting certain driving waveform W. Further, by setting the correction values for four driving waveforms W, the amount of data is increased and thus memory capacity is also increased.

By contrast, as the above-described embodiment, the first waveform W(1) to the third waveform W(3) are not corrected, but are generated as design, so that at the time of application of the second waveform W(2) to the fourth waveform W(4) after application of the first waveform W(1) to the third waveform W(3), the meniscus state is already made in uniform even though it is not adjusted. That is, only the second hold time Pwh2 of the final driving waveform W(4) is corrected so as to stabilize the ejection characteristic of ink droplets, so that the correction processing is easy. Further, the ejection characteristic of ink droplets can be more surely stabilized, and the amount of data and memory capacity can be reduced.

Regarding the Correction of the Driving Waveform W at Printing

In order to suppress the variation of the head velocity Vc at acceleration or deceleration, that is, the fluctuation of the ejection characteristic of the ink droplets (the quantity of the ink ejection or the like) produced by the varied frequency of the driving waveform W for one pixel, the case of correcting the second hold time Pwh2 of the final driving waveform W(4) in the repetition cycle T will now be described.

First Example of the Correction

In the first example of the correction, the controller 10 of the printer 1 calculates the moving velocity Vc of the head 41 based on the slit interval (180 dpi) and the time interval of the signal of the linear encoder provided at the rear side of the head 41 and detecting the slit of the linear scale 51, and corrects the parameter of the final driving waveform W(4) in the repetition cycle T, based on the moving velocity Vc of the head 41. However, in the case of calculating the current head velocity Vc based on the signal of the linear encoder detecting the slit, and correcting the driving waveform W used for the ejection of the ink droplets in the present based on the correction value according to head velocity Vc, there may be a time difference due to operation processing or the like. Consequently, the moving velocity Vc of the head 41 in the future may be predicted based on the current moving velocity Vc of the head 41. To this end, it is preferable that a slope (FIG. 7B) in the variation of the head velocity Vc at the acceleration and deceleration of the head 41 is stored in the memory 13 of the printer 1.

Further, in the first example of the correction, since the controller 10 corrects the final driving waveform W(4) in the repetition cycle T based on the calculated head velocity Vc, the table corresponding to the head velocity Vc and the correction values is stored in the memory 13, as shown in FIG. 10.

More specifically, in the case in which the printing is performed by using the acceleration and deceleration region (e.g., in the case in which a size of the print paper is large, and the whole printing region is used), the controller 10 calculates the head moving velocity Vc of the head 41 whenever the linear encoder detects the slit of the linear scale 51. In this way, the controller 10 predicts the future head velocity Vc based on the current moving velocity Vc of the head 41. For example, based on the current head velocity Vc, the controller predicts the head velocity Vc when "a certain nozzle" passes a pixel which is the fifth one ahead of a pixel to which "a certain nozzle" belonging to the head 41 faces.

After that, the controller 10 obtains the correction value ΔX of the second hold time Pwh2 corresponding to the predicted future head velocity Vc, by referring to the correction value table shown in FIG. 11. In this way, the controller 10 corrects the DAC value (data for generating the driving waveform W, in which it is not limited to a digital value, and an analog value is possible) so as to correct the second hold time Pwh2 of the fourth waveform W(4) of the driving signal COM which is used when a certain nozzle faces the pixel which is the fifth one ahead of a pixel, as the correction value ΔX, and transmits it to the driving signal generating circuit 15 (corresponding to the driving signal generating unit). The driving signal generating signal 15 generates the driving signal COM, of which the second hold time Pwh2 of the final driving waveform W(4) is corrected according to the predicted future head velocity Vc based on the DAC value, and transmits the driving signal COM to the head control unit HC at the timing that a certain nozzle faces the pixel which is the fifth one ahead of the pixel.

That is, in the first example of the correction, the controller 10 predicts the head velocity Vc after a predetermined time based on the current head velocity Vc, and generates the driving signal COM which is corrected based on the head velocity Vc, of which the final driving waveform W(4) in the repetition cycle T is predicted, in the driving signal generating circuit 15. Based on the predicted head velocity Vc, the ink droplets are ejected from the head 41 in the repetition cycle T after a predetermined time, by the driving signal COM of which the final driving waveform W(4) is corrected. In this way, the meniscus state at the start time of application of the initial driving waveform W(1) in the repetition cycle T next to the repetition cycle T after a predetermined time can be equal to the meniscus state at the start time of application of other driving waveform W, thereby stabilizing the ejection characteristic of the ink droplets.

Second Example of the Correction

FIG. 13A is a view showing a relationship between slit numbers of the linear scale 51 and the acceleration and deceleration region, FIG. 13B is a view showing a relationship between the moving velocity Vc of the head 41 and the slit numbers, and FIG. 13C is a view showing a correction value table in which correction values ΔX of the second hold time Pwh2 are set to the slit numbers. Here, as shown in FIG. 13A, the slits of the linear scale 51 are designated by numbers increasing from a left side to a right side in the moving direction. Further, the controller 10 counts the number of the slits detected by the linear encoder to obtain the number of slit in which the linear encoder is positioned and thus the position of the head 41 in the moving direction.

Further, in the case in which the head velocity Vc (the reference head velocity Vcs) in the constant-velocity region is same, the variation of the head velocity Vc becomes the head velocity Vc shown in FIG. 13B, and a slope in the variation of the head velocity Vc is constant. For this reason, the head velocity Vc in the acceleration and deceleration region can be predicted by the time from the motion start of the head 41 and the time from the deceleration start of the head 41. Further, the linear encoder always maintains the slit number (i.e., the position of the head 41 in the moving direction) to be constant facing the linear encoder at the motion start (time 0 in FIG. 13B) of the head 41 and the slit number facing the linear encoder at the deceleration start time (time t2) of the head 41, so that the head velocity Vc can be predicted by the slit number detected by the linear encoder.

Consequently, in the second example of the correction, the controller 10 predicts the head velocity Vc in accordance with the slit number detected by the linear encoder, without directly calculating the head velocity Vc. In this way, the final driving waveform W(4) in the repetition cycle T of the driving signal COM which is used at the head velocity Vc corresponding to the slit number is corrected. That is, in the second example of the correction, the final driving waveform W(4) in the repetition cycle T is corrected by the head velocity Vc indirectly obtained by the slit number.

For this reason, in the process of designing the printer 1, after "the relationship between the head velocity Vc and the correction value of the final driving waveform W(4) (the correction value ΔX of the second hold time Pwh2)" is calculated by the simulation or experiment, as shown in FIG. 11, the head velocity Vc is substituted by the slit number. In this way, as shown in FIG. 13C, "the table corresponding to the slit number and the correction value of the final driving waveform W(4)" is prepared. The correction value table of FIG. 13C is stored in the memory 13 of the printer 1.

For purpose of illustration, in FIG. 13, the head 41 is moved from the left side to the right side in the moving direction, and as shown in FIG. 13A, 10 slits (1 to 10) from the left side in the moving direction are referred to as "slits of the acceleration region", and 10 slits (n to n-9) from the right side in the moving direction are referred to as "slits of the deceleration region". More specifically, when the linear encoder detects "the slit 1", it is the motion start time of the head 41, and the head velocity Vc approximates zero. When the linear encoder detects "the slit 10", the head is just about to transfer from the acceleration region to the constant-velocity region, and the head velocity Vc approximates the head velocity Vcs of the constant-velocity region. Similarly, when the linear encoder detects "the slit n-9", the head is immediately after transference from the constant-velocity region to the deceleration, and the head velocity Vc approximates the head velocity Vcs of the constant-velocity region. When the linear encoder detects "the slit n", the head 41 is just before the stop, and the head velocity Vc approximates zero. In this way, the slit number and the head velocity Vc can correspond to each other.

In the printing of the acceleration and deceleration region, the controller 10 obtains the slit number according to the slit detecting signal of the linear encoder, and the correction value corresponding to the slit number based on the correction value table shown in FIG. 13C. The controller generates the driving signal COM, of which the final driving waveform W(4) in the repetition cycle T is corrected by the correction value, in the driving signal generating circuit 15. That is, when the linear encoder detects the slit number i, the controller 10 controls the ejection of the ink droplets in such a way that the ink droplets are ejected in response to the driving signal COM, of which the final driving waveform W(4) in the repetition cycle T is corrected by the correction value corresponding to the slit i. In this way, since the head velocity Vc is changed in the acceleration and deceleration region, even though the frequency f of the driving waveform W is changed, the ejection characteristic of the ink droplets can be stabilized.

In the second example of the correction, since the controller 10 does not calculate the head velocity Vc and the head velocity Vc is substituted by the slit number (the position of the head 41 in the moving direction), it is possible to decrease the processing of the controller 10 which calculates the head velocity Vc, thereby shortening the processing time.

In this instance, it is not limited such that the head velocity Vc is substituted by the slit number, and the correction value of the final driving waveform W(4) corresponds to the slit number. If the variation of the head velocity Vc is constant (if the slope in the variation of the head velocity Vc in FIG. 13B is constant), the head velocity Vc can be predicted by the time from the motion start of the head 41 and the time from the deceleration start of the head 41. That is, the correction value of the final driving waveform W(4) in the repetition cycle T may correspond to the time from the motion start of the head 41 and the time from the deceleration start of the head 41.

Third Example of the Correction

FIG. 14 is a view showing a correction value table in which the correction value ΔX of the second hold time Pwh2 corresponds to the slit number. In the first and second examples of the correction, in the case in which the head velocity Vc is slow in the acceleration and deceleration region and the frequency f of the driving waveform W for one pixel is low or in the case in which, the head velocity Vc is fast and the frequency f of the driving waveform W for one pixel is high, the same number of the correction values ΔX are set at a predetermined interval of the head velocity Vc (at an interval of the predetermined number of the slits and at an interval of the predetermined time).

More specifically, in the first example of the correction, in the correction value table shown in FIG. 11, a difference between the head velocity 0 and the head velocity Vc(1) is equal to a difference between the head velocity Vc(1) and the head velocity Vc(2), and one correction value is set for a variation amount as the head velocity Vc. Further, in the second example of the correction, as shown in FIG. 13C, one correction value is set for every slit.

According to the graph showing the relationship of the frequency f and the quantity of ink ejection in FIG. 9, when the frequency f of the driving waveform W is low for one pixel (e.g., frequencies f2 to f3), the fluctuation in the quantity of the ink ejection with respect to the variation of the frequency f is small, as compared with when the frequency f of the driving waveform W is high for one pixel (e.g., frequencies f3 to f1). That is, even in the same acceleration and deceleration region, in the case in which the head velocity Vc is slow and thus the repetition cycle T is relatively long, the difference in the quantity of the ink ejection before and after the repetition cycle T is small. By contrast, in the case in which the head velocity Vc accelerates and thus the repetition cycle T is relatively short, the difference in the quantity of the ink ejection before and after the repetition cycle T is large.

Accordingly, in the third example of the correction, in the case in which the head velocity Vc is fast and then the frequency f of the driving waveform W for one pixel is high, since the head velocity Vc is slow, the number of the correction values of the driving waveform W(4) set to the predetermined varied quantity (a predetermined varied quantity of the frequency f) of the head velocity Vc is set to be small, as compared with the case in which the frequency f of the driving waveform W for one pixel is low. In other words, when the head velocity Vc is slow and thus the frequency f of the driving waveform W for one pixel is low, the same correction value is used with respect to the driving waveform W in the predetermined numbers of repetition cycles T. When the head velocity Vc is fast and thus the frequency f of the driving waveform W for one pixel is high, the same correction value is used with respect to the driving waveform W in the repetition cycles T less than the predetermined number.

In this way, when the frequency f of the driving waveform W is high (when the head velocity Vc is fast), the driving waveform W can be corrected in accordance with the frequency f of the respective driving waveforms W, thereby stabilizing the quantity of the ink ejection (the ejection characteristic). By contrast, when the frequency f of the driving waveform W is low (when the head velocity Vc is slow), since the same correction value is used with respect to the driving waveforms W of the plurality of frequencies f, the capacity of the correction value table stored in the memory 13 of the printer 1 can be reduced, and the controller 10 can easily perform the process of correcting the driving waveform W. Further, when the frequency f of the driving waveform W is low, since the variation in the quantity of the ink ejection with respect to the fluctuation of the frequency f is small, the quantity of the ink ejection is not dramatically changed, thereby stabilizing the quantity of the ink ejection (the ejection characteristic), even though the same correction value is used with respect to the driving waveform W of the plurality of frequencies f.

For example, as shown in FIG. 14, it is supposed that the head velocity Vc is substituted by the slit number, and then the correction value table corresponding to the slit number and the correction value of the final driving waveform W(4) has been prepared. In this instance, when the head velocity Vc is slow and then the frequency f of the driving waveform W is low, that is, at the motion start of the head 41, only one correction value ΔX(1) is set to the slits "1 to 3" detected by the linear encoder. This indicates that when the slits 1 to 3 are detected by the linear encoder, the final driving waveform W(4) of the driving signal COM used to eject the ink droplets from the head 41 is corrected by the same correction value ΔX(1).

Similarly, when the head velocity is slow and then the frequency f of the driving waveform W is low, that is, just before the head 41 stops, only one correction value ΔX(1) is set to the slits "n to n-2" detected by the linear encoder. That is, immediately after the head 41 starts to move and immediately before the head stops, only one correction value ΔX(1) is set to three slits. In other words, one correction value is set to the time when three slits pass through the head 41 and the head velocity Vc when three slits pass through the head 41.

As the head velocity Vc is faster immediately after the motion start of the head 41 or immediately before the stop of the head, the frequency f is higher, and then one correction value is set to two slits (e.g., slits 4 to 5). Finally, when the frequency f is even higher in the vicinity of the constant-velocity region, one correction value is set to every one slit (e.g., the slit 10).

In this way, the number of the correction values set to the head velocity Vc between a certain head velocity Vc (corresponding to the first relative moving velocity) and the head velocity Vc which is produced by adding a predetermined velocity to a certain head velocity Vc is more than the number of the correction values set to the head velocity Vc until the head velocity Vc which is produced by adding a predetermined velocity to other head velocity Vc (corresponding to the second relative velocity) which is slower than a certain head velocity Vc. In this way, the head velocity Vc is faster, and then the frequency of the driving waveform W becomes high. Consequently, the correction value of the driving waveform W can be increased in accordance with the respective frequencies, thereby further stabilizing the ejection characteristic of the ink droplets.

Other Embodiments

While the printing system including an ink jet printer is described in each of the embodiments, the disclosure of the method for correcting the driving signal or the like is included. The embodiments are intended not to definitively interpret the invention but to facilitate comprehension thereof. It is apparent to those skilled in the art that the invention can be modified and varied, without deviating from its teachings, and includes its equivalents. In particular, the embodiments described below are contained in the invention.

Regarding the Encoder Cycle

Since the slit interval of the linear scale 51 detected by the linear encoder is set to be equal to a length of one pixel in the above-described embodiment, the interval (the encoder cycle) of the slit detecting signal by the linear encoder is equal to the repetition cycle T (the interval of the latch signal LAT) which is a period to produce the driving waveform W for one pixel. However, there is a case of performing the printing in pixel units smaller than the slit interval of the linear scale 51. For example, if the length of one pixel is a half of the slit interval, the controller 10 generates the rising pulse of the latch signal LAT every half time of the encoder cycle, and the driving waveform W for one pixel is generated over the half time of the encoder cycle. In this instance, similar to the above-described embodiment, it is preferable that the final driving waveform W of the driving waveforms W for one pixel in the repetition cycle T is corrected. Further, although the slit interval of the linear scale is different from the length of one pixel, in the case in which the driving waveforms W for two pixels are generated every slit detecting signal of the linear encoder, the final driving waveform W of the driving waveforms W for two pixels is corrected.

Regarding Changing of a Velocity Mode in the Constant-Velocity Region

In the above-described embodiment, since the head velocity Vc in the acceleration and deceleration region is changed with respect to the head velocity Vcs in the constant-velocity region and the head velocity Vc in the acceleration and deceleration region is changed, the final driving waveform W in the previous repetition cycle T is corrected in order to prevent the ejection characteristic of the ink droplets from being varied due to the changed frequency f of the driving waveform W. However, in order to use the acceleration and deceleration region in the printing, it is not limited such that the final driving waveform W in the repetition cycle T is corrected when the frequency of the driving waveform W is changed. For example, in a printer in which "a fast mode" and "a slow mode (clean mode)" can be set, the moving velocity Vc of the head in the constant-velocity region of the different printing mode is different. Although the head velocity Vc in constant-velocity region is changed by the printing mode, the frequency of the driving waveform is varied according to the printing mode, in the case in which the driving waveform W for one pixel is not changed. Accordingly, it is preferable that the ejection characteristic of the ink droplets is stabilized by correcting the final driving waveform of the repetition cycle T in response to the print mode in the constant-velocity region.

Regarding the Correction Based on the Print Data

In the above-described embodiment, the driving signal COM generating four driving waveforms as a driving waveform for one pixel is cited as an example. In the case of representing one pixel in two grayscales, four driving waveforms W are applied, or the driving waveform W is not applied. In this instance, if the print data represents "dot formation", the final driving waveform (the fourth waveform W(4)) in the repetition cycle T is always used. For this reason, if the case in which the frequency f of the driving waveform W is high, the interval between the fourth waveform W(4) and the first waveform W(1) is shortened, the first waveform W(1) is applied while the residual vibration of the meniscus due to the ink ejection of the fourth waveform W(4) is not damped. Thus, in the acceleration and deceleration region, the meniscus state of the first waveform W(1) is displaced by the variation in the interval between the fourth waveform W(4) and the first waveform W(1), so that the ejection characteristic of the ink droplets is fluctuated.

For this reason, as the case of representing one pixel in two grayscales, when the ink is ejected in the repetition cycle T next to a certain repetition cycle T, the final driving waveform W(4) in a certain repetition cycle T is always corrected based on the head velocity Vc. Further, in the case the ink is not ejected in the repetition cycle T next to a certain repetition cycle T, since the residual vibration of the meniscus during the next repetition cycle T is damped, the final driving waveform W(4) in a certain repetition cycle T is not necessarily corrected.

In the case in which it is determined that the ink droplets are ejected in the next cycle based on the print data (the image data), the controller 10 generates the driving signal COM, of which the final driving waveform W(4) in the previous repetition cycle T (corresponding to a certain repetition cycle) is corrected based on the head velocity Vc, in the driving signal generating circuit 15. In the case in which it is determined that the ink droplets are not ejected in the next cycle, the controller 10 may generate the driving signal COM, of which the final driving waveform W(4) in the previous repetition cycle T is not corrected based on the head velocity Vc, in the driving signal generating circuit 15. In this way, in the case in which the ink droplets are not ejected in the next cycle, the controller 10 does not necessarily calculate the head velocity Vc or obtain the correction value, and generates the same driving signal COM as the driving signal COM in the constant-velocity region in the driving signal generating circuit 15, thereby easily performing the correction processing.

In the case of representing one pixel in three grayscales, for example, it is supposed that there is a case in which four driving waveforms W(1) to W(4) for forming large dots are applied to the piezoelectric element, and a case in that two center driving waveforms W(2) and W(3) for forming small dots are applied to the piezoelectric element. In the case of forming the large dots, the fourth waveform W(4) in the repetition cycle previous to a certain repetition cycle T is applied, but in the case of forming the small dots, the fourth waveform W(4) is not applied. For this reason, if the residual vibration of the meniscus due to the ink ejection of the third waveform W(3) is damped between the time in which the third waveform W(3) for forming the small dots is applied to the piezoelectric element and the time in which the first waveform W(1) is applied to the piezoelectric element, even though the interval between the third waveform W(3) and the first waveform W(1) fluctuates in the acceleration and deceleration region, the meniscus state is not displaced at the start time of application of the first waveform W(1), so that the ejection characteristic is not varied. As a result, in the case of forming the small dots, the third waveform W(3) finally applied to the piezoelectric element in the repetition cycle T is not necessarily corrected based on the head velocity Vc. In the case of forming the large dots, the fourth waveform W(4) finally applied to the piezoelectric element in the repetition cycle T is corrected based on the head velocity Vc. If the residual vibration of the meniscus is not damped between the time in which the third waveform W(3) is applied to the piezoelectric element and the time in which the first waveform W(1) is applied to the piezoelectric element, when the small dots are formed, the third waveform W(3) (corresponding to the final driving waveform among a plurality of driving waveforms generated in the cycle) is corrected based on the head velocity Vc. Further, when the ink droplets are not ejected in the next repetition cycle T, it is not necessary to correct the final driving waveform W in the previous repetition cycle T in the case in which the small dots are formed in the previous repetition cycle and the case in which the large dots are formed in the previous repetition cycle.

Regarding Other Printers

In the above-described embodiment, the serial printer which ejects the ink while one head 41 moves in a direction intersecting with the paper transport direction is described as an example, but it is not limited thereto. For example, it can be applied to a line printer which ejects the ink from the head fixed to the paper which is transported under a head (nozzle array) having nozzles extended in parallel in the moving direction across a width of the paper. In the line printer, the head is not moved, but the paper is transported with respect to the head. Even though the paper is transported with respect to the head at a predetermined velocity, the transport velocity of the paper with respect to the head is slower than the predetermined velocity at the time in which the transport of paper starts or the transport of the paper stops. In such a line printer, since the transport velocity of the paper with respect to the head is changed and thus the frequency of the driving waveform is fluctuated, the ejection characteristic of the ink droplets is varied. As a result, the ejection characteristic of the ink droplets can be stabilized by correcting the driving waveform finally generated in the previous repetition cycle.

In addition, the invention is not limited to the serial printer, and may be applied to a printer which repeatedly performs an operation in which a head moves in a transport direction of a continuous sheet with respect to the continuous sheet transported in a printing region to form an image, and an operation in which the head moves in a direction intersecting with the transport direction.

Regarding the Fluid Ejecting Apparatus

In the above-described embodiment, the ink jet printer is illustrated as the fluid ejecting apparatus, but it is not limited thereto. It can be applied to various industrial apparatuses as the fluid ejecting apparatus, in addition to the printer (printing apparatus). For example, the invention can be applied to, for example, a printing apparatus for transferring a pattern on clothes, a display fabricating apparatus, such as a color-filter fabricating apparatus or an organic EL fabricating apparatus, a DNA chip fabricating apparatus for fabricating a DNA chip by applying a solution dissolved with DNA on a chip.

Further, the method for ejecting the fluid includes a piezoelectric method for ejecting the fluid by applying a voltage to a driving element (a piezoelectric element) to expand and contract an ink chamber, and a thermal method for ejecting the fluid by generating bubbles in the nozzles using a thermal element.

Regarding the Driving Waveform

In the above-described embodiment, the head 41 (FIG. 2) in which the pressure chamber 412*d* is expanded when the potential applied to the driving element is increased and the pressure chamber 412*d* is contracted when the potential is lowered, but it is not limited thereto. In the case of the head in which the pressure chamber is contracted when the potential applied to the driving element is increased and the pressure chamber is expanded when the potential is lowered, a driving waveform which is similar to the reversed driving waveform W shown in FIG. 5B may be used.

What is claimed is:

1. A fluid ejecting apparatus comprising:

(A) a head that ejects a fluid on a medium in response to a driving signal;

(B) a moving mechanism that relatively moves the head and the medium in a predetermined direction;

(C) a driving signal generating unit that generates the driving signal which produces a plurality of driving waveforms during a cycle in accordance with a relative moving velocity of the head and the medium in a predetermined direction, the plurality of driving waveforms being repeatedly produced every cycle; and (D) a control unit that ejects the fluid from the head while the head and the medium are relatively moved in the predetermined direction, and causes the driving signal, of which a final driving waveform among the plurality of driving waveforms produced during the cycle is corrected based on the relative moving velocity, to be generated from the driving signal generating unit.

2. The fluid ejecting apparatus according to claim 1, wherein the driving waveform is applied to a driving element corresponding to the nozzle provided in the head, so that the driving element is driven;

the driving of the driving element causes a pressure chamber communicating with the nozzle corresponding to the driving element to expand or contract, thereby ejecting the fluid from the nozzle;

the driving waveform includes an expansion element that expands the pressure chamber, a contraction element that contracts the expanded pressure chamber, and a damping element that suppresses residual vibration generated in the pressure chamber; and the control unit causes the driving signal generating unit to generate the driving signal, of which the damping element of the final driving waveform is corrected based on the relative moving velocity.

3. The fluid ejecting apparatus according to claim 1, further comprising a memory that stores a correction value for correcting the final driving waveform based on the relative moving velocity, wherein the number of the correction values set with respect to the relative moving velocity from a first relative moving velocity to the relative moving velocity which is produced by adding a predetermined velocity to the first relative moving velocity is more than the number of the correction values set with respect to the relative moving velocity from a second relative moving velocity which is slower than the first relative moving velocity to the relative moving velocity which is produced by adding the predetermined velocity to the second relative moving velocity.

4. The fluid ejecting apparatus according to claim 1, wherein the driving waveform is applied to the driving element corresponding to the nozzle provided in the head, so that the driving element is driven;

the driving of the driving element causes the pressure chamber communicating with the nozzle corresponding to the driving element to expand or contract, thereby ejecting the fluid from the nozzle;

the driving waveform includes an expansion element that expands the pressure chamber, a hold element that maintains an expansion state of the pressure chamber, and a contraction element that contracts the expanded pressure chamber; and the control unit causes the driving signal generating unit to generate the driving signal, of which the hold element of the final driving waveform is corrected based on the relative moving velocity.

5. The fluid ejecting apparatus according to claim 1, wherein the driving waveform is applied to a driving element corresponding to the nozzle provided in the head, so that the driving element is driven;

the driving of the driving element causes the pressure chamber communicating with the nozzle corresponding to the driving element to expand or contract, thereby ejecting the fluid from the nozzle;

the driving waveform includes an expansion element that expands the pressure chamber, and a contraction element that contracts the expanded pressure chamber; and the control unit causes the driving signal generating unit to generate the driving signal, of which the expansion element of the final driving waveform is corrected based on the relative moving velocity.

6. The fluid ejecting apparatus according to claim 1, wherein the control unit determines whether or not the fluid is ejected from the head in the next cycle of a certain cycle based on the image data;

in the case in which the fluid is ejected from the head in the next cycle, the driving signal generating unit generates the driving signal of which the final driving waveform of the certain cycle is corrected based on the relative moving velocity; and in the case in which the fluid is not ejected from the head in the next cycle, the driving signal generating unit generates the driving signal of which the final driving waveform of a certain cycle is not corrected based on the relative moving velocity.

7. A fluid ejecting method for ejecting a fluid from a head in response to a driving signal while the head and a medium are relatively moved in a predetermined direction, the method comprising:

producing a plurality of driving waveforms during a cycle in accordance with a relative moving velocity of the head and the medium in the predetermined direction, to correct a final driving waveform among the plurality of driving waveforms produced during the cycle in the plurality of driving waveforms which are repeatedly produced for every cycle based on the relative moving velocity; and ejecting the fluid from the head in response to the driving signal.

* * * * *